US010648465B2

(12) United States Patent
Gaskill-Fox et al.

(10) Patent No.: US 10,648,465 B2
(45) Date of Patent: May 12, 2020

(54) CONTINUOUS SAMPLE DELIVERY PERISTALTIC PUMP

(71) Applicant: Bio-Rad Laboratories, Inc., Hercules, CA (US)

(72) Inventors: Nathan Michael Gaskill-Fox, Fort Collins, CO (US); Daniel Nelson Fox, Bellvue, CO (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 622 days.

(21) Appl. No.: 15/345,462

(22) Filed: Nov. 7, 2016

(65) Prior Publication Data

US 2018/0128266 A1 May 10, 2018

(51) Int. Cl.
*F04B 49/20* (2006.01)
*F04B 43/12* (2006.01)
(Continued)

(52) U.S. Cl.
CPC ..... *F04B 49/20* (2013.01); *F04B 11/00* (2013.01); *F04B 23/06* (2013.01);
(Continued)

(58) Field of Classification Search
CPC ..... F04B 11/00; F04B 23/04; F04B 23/06; F04B 43/00; F04B 43/0072;
(Continued)

(56) References Cited

U.S. PATENT DOCUMENTS 3,335,670 A 8/1967 Williams
4,445,826 A 5/1984 Tarr
(Continued)

FOREIGN PATENT DOCUMENTS

CN 103423134 A 12/2013
CN 103874857 A 6/2014
(Continued)

OTHER PUBLICATIONS

International Search Report and Written Opinion dated Oct. 28, 2016 issued in PCT/US16/47877.
(Continued)

*Primary Examiner* — Philip E Stimpert
(74) *Attorney, Agent, or Firm* — Weaver Austin Villeneuve & Sampson LLP

(57) ABSTRACT

Methods and systems for pumping fluid through tubing are provided. Methods include orbiting one or more first rollers at multiple angular speeds around the periphery of a substantially circular first disk having a first radius with each first roller travelling at the same angular speed as the other first rollers, orbiting second rollers at a second angular speed around a substantially circular second disk having substantially the first radius, and increasing the pressure of fluid in tubing between one first roller and one second roller by causing the one or more first rollers to orbit at a first angular speed greater than the second angular speed so the one first roller moves along and fully compresses the tubing in a first section of the first disk, and simultaneously causing the one second roller to move along and fully compress the tubing in a first section of the second disk.

19 Claims, 15 Drawing Sheets

(51) Int. Cl.

| | |
|---|---|
| ***F04B 43/00*** | (2006.01) |
| ***F04B 49/06*** | (2006.01) |
| ***F04B 51/00*** | (2006.01) |
| ***F04B 49/08*** | (2006.01) |
| ***F04B 11/00*** | (2006.01) |
| ***F04B 23/06*** | (2006.01) |

(52) U.S. Cl.
CPC ..... *F04B 43/0072* (2013.01); *F04B 43/1261* (2013.01); *F04B 49/065* (2013.01); *F04B 49/08* (2013.01); *F04B 51/00* (2013.01); *F04B 2205/04* (2013.01); *F04B 2205/503* (2013.01)

(58) Field of Classification Search
CPC .. F04B 43/1261; F04B 43/08; F04B 43/1253; F04B 45/00; F04B 45/06; F04B 45/08; F04B 49/065; F04B 49/20
See application file for complete search history.

(56) References Cited

U.S. PATENT DOCUMENTS

| | | | | |
|---|---|---|---|---|
| 5,533,878 | A | 7/1996 | Iwata | |
| 5,711,654 | A | 1/1998 | Afflerbaugh | |
| 8,939,740 | B2 | 1/2015 | Norman et al. | |
| 10,309,388 | B2 | 6/2019 | Gaskill-Fox et al. | |
| 2002/0179544 | A1* | 12/2002 | Johnson | A61M 1/02 210/806 |
| 2004/0131487 | A1 | 7/2004 | Ito | |
| 2009/0214365 | A1 | 8/2009 | Norman et al. | |
| 2010/0316516 | A1 | 12/2010 | Vidal | |
| 2014/0356203 | A1 | 12/2014 | Baxter | |
| 2015/0104329 | A1* | 4/2015 | Chin | F04B 49/007 417/53 |
| 2017/0051735 | A1 | 2/2017 | Gaskill-Fox et al. | |

FOREIGN PATENT DOCUMENTS

| | | |
|---|---|---|
| DE | 3326766 A1 | 2/1984 |
| JP | 2008/261240 | 10/2008 |
| JP | 2013/072287 | 4/2013 |
| WO | WO 2017/035020 | 3/2017 |

OTHER PUBLICATIONS

"Summary of Disclosures and Products Sold Prior to Nov. 7, 2016," Bio-Rad Laboratories, Inc., Hercules, California, pp. 1.
"Yeti Cell Analyzer," [Brochure], CYTO Conference in Glasgow, Scotland, Jun. 26-30, 2015, Propel Labs, Inc., pp. 9.
"Yeti Cell Analyzer; Technology Advancements to Improve High Throughput Analysis," (PowerPoint Presentation) Inventor Daniel Nelson Fox of Propel Labs, Inc., Feb. 4, 2016, pp. 6.
"ZE5 Cell Analyzer Users Guide—Beta," (User Manual) Dec. 16, 2015, Propel Labs, Inc., pp. 12-13.
"Fast and Furious Floy Cytometry," (PowerPoint Presentation) Jul. 22, 2016, Inventor Daniel Nelson Fox of Propel Labs, Inc., pp. 5.
U.S. Notice of Allowance dated Jan. 28, 2019 for U.S. Appl. No. 15/242,122.
U.S. Notice of Allowance (corrected) dated Mar. 13, 2019 for U.S. Appl. No. 15/242,122.
Chinese Office Action dated Jan. 3, 2019 for CN Application No. 201680049919.7.
Extended European Search Report dated Nov. 30, 2018, for EP Application No. 16839908.7.
International Preliminary Report on Patentability dated Mar. 8, 2018 issued in PCT/US16/47877.
Chinese Second Office Action dated Aug. 26, 2019, for CN Application No. 201680049919.7.
European Communication under Rule 71(3) dated Aug. 6, 2019, for EP Application No. 16839908.7.

* cited by examiner

Figure 7A
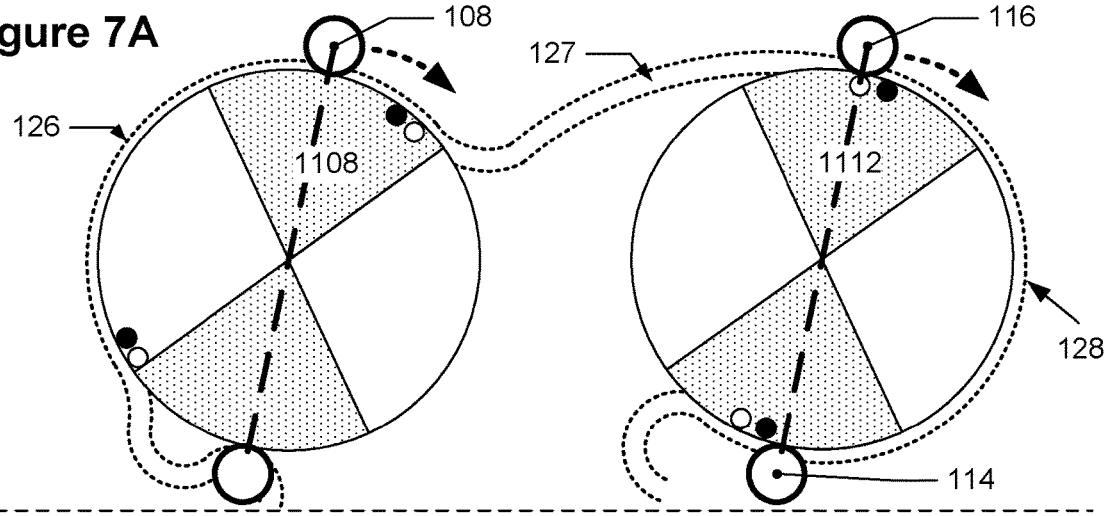
Figure 7B
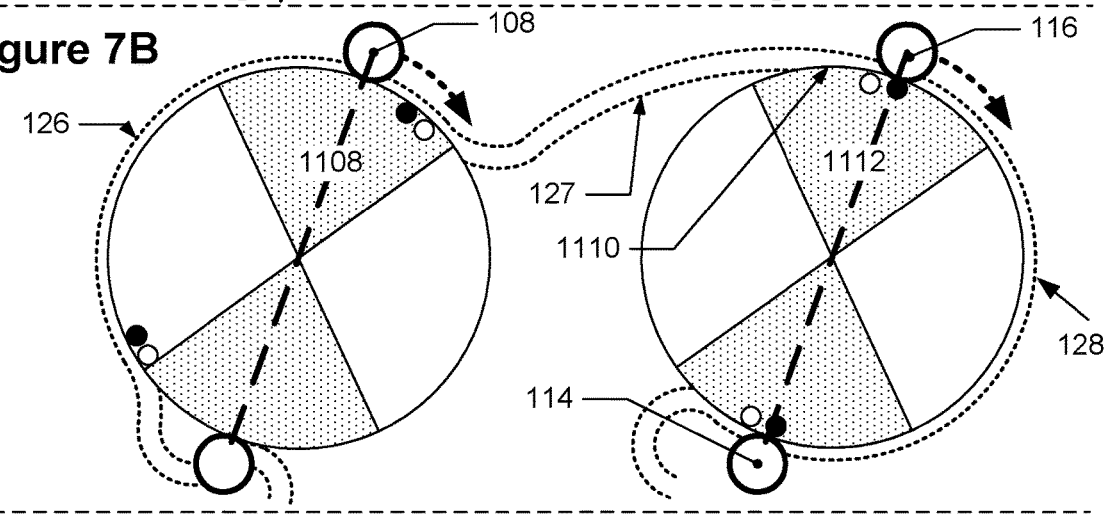
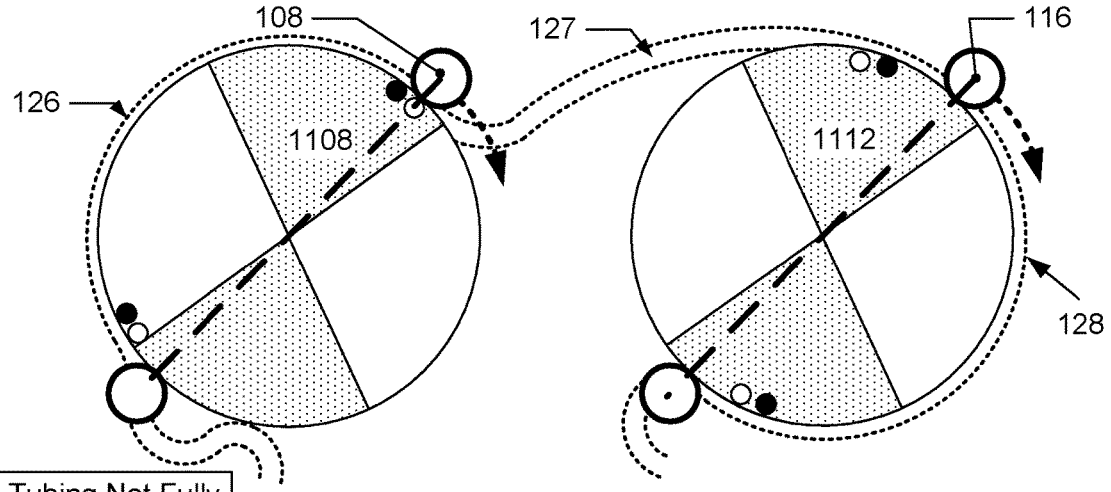
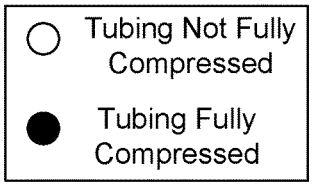
Figure 7C

CONTINUOUS SAMPLE DELIVERY PERISTALTIC PUMP

CROSS REFERENCE TO RELATED APPLICATIONS

This application is related to U.S. application Ser. No. 15/242,122, filed on Aug. 19, 2016, entitled "CONTINUOUS SAMPLE DELIVERY PERISTALTIC PUMP," and U.S. Provisional Application No. 62/208,465, filed on Aug. 21, 2015, entitled "CONTINUOUS SAMPLE DELIVERY PERISTALTIC PUMP," both of which are incorporated by reference herein in their entirety.

BACKGROUND

Various types of pumps exist for the purpose of pumping fluids, such as liquids. Many flow cytometers use peristaltic pumps, which have many advantages. Peristaltic pumps are positive displacement pumps. The fluid being pumped only contacts the flexible tubing and is not exposed to other pump components which could possibly cause contamination of the fluid being pumped. Both highly sterile fluids, as well as chemicals, can be pumped through a peristaltic pump since the fluids only contact the flexible tubing. Peristaltic pumps are especially suited for pumping abrasives, viscous fluids, and biological fluids.

SUMMARY

Discussed herein are various apparatuses and methods for peristaltically pumping fluids.

In one embodiment, a method of pumping a fluid through tubing that is positioned partially around the periphery of a first disk of a peristaltic pump and partially around the periphery of a second disk of the peristaltic pump is provided. The method may include orbiting one or more first rollers at two or more angular speeds around the periphery of the first disk such that the one or more first rollers may be pressed into contact with the periphery of the first disk, the tubing, or the periphery of the first disk and the tubing. The first disk may be substantially circular and may have a first radius and each first roller may travel at the same angular speed as the other first rollers. The method may further include orbiting a plurality of second rollers at a second angular speed around the entire periphery of the second disk such that the second rollers may be pressed into contact with the periphery of the second disk, the tubing, or the periphery of the second disk and the tubing. The second disk may be substantially circular and may have a second radius that is substantially the same as the first radius. The method may further include increasing the pressure of a portion of the fluid in the tubing between one first roller and one second roller by causing the one or more first rollers to orbit at a first angular speed so that the one first roller moves along and fully compresses the tubing in a first section of the periphery of the first disk, and simultaneously causing the one second roller to move along and fully compress the tubing in a first section of the periphery of the second disk. The first angular speed may be greater than the second angular speed. The method may further include moving, after increasing the pressure of the portion of the fluid, the portion of the fluid through the tubing at a constant pressure towards an output of the tubing by causing the one or more first rollers to orbit at the second angular speed while the one first roller moves along and is fully compressing the tubing in a second section of the periphery of the first disk, and simultaneously causing the one second roller to fully compress the tubing.

In some embodiments, the method may further include reducing, after increasing the pressure of the portion of the fluid and before moving the portion of the fluid through the tubing at the constant pressure towards the output of the tubing, the angular speed of the one or more first rollers from the first angular speed to the second angular speed.

In some embodiments, the method may further include reducing, after moving the portion of the fluid through a part of the tubing at a constant pressure towards the output of the tubing, the angular speed of the one or more first rollers to a third angular speed that is less than the second angular speed.

In some such embodiments, the third angular speed may be zero.

In some other such embodiments, the one or more first rollers may move at the third angular speed while each of the first rollers may be not fully compressing the tubing.

In some other such embodiments, orbiting one or more first rollers at two or more angular speeds around the periphery of the first disk may further include orbiting two or more first rollers and the method may further include increasing, after reducing the speed of the two or more first rollers to a third angular speed, the pressure of another portion of the fluid in the tubing between another first roller of the two or more first rollers and another second roller of the plurality of second rollers by causing the two or more first rollers to orbit at the first angular speed while the other first roller moves along and fully compresses the tubing in the first section of the periphery of the first disk, and by simultaneously causing the other second roller to move along and fully compress the tubing in the first section of the periphery of the second disk. In such embodiments, the first angular speed may be greater than the second angular speed during such movement.

In some further such embodiments, the method may include orbiting, after stopping the movement of the two or more first rollers and before increasing the pressure of the other portion of the fluid in the tubing between the other first roller and the other second roller, the two or more first rollers at an angular speed less than or equal to second angular speed.

In some such embodiments, orbiting one or more first rollers at two or more angular speeds around the periphery of the first disk may further include orbiting two or more first rollers and the method may further include increasing, after stopping the movement of the two or more first rollers, the pressure of another portion of the fluid in the tubing between another first roller of the two or more first rollers and another second roller of the plurality of second rollers by causing the two or more first rollers to orbit at the first angular speed while the other first roller moves along and fully compresses the tubing in a third section of the periphery of the first disk, and by simultaneously causing the other second roller to move along and fully compress the tubing in a third section of the periphery of the second disk. In such embodiments, the first angular speed may be greater than the second angular speed.

In some other such embodiments, orbiting one or more first rollers at two or more angular speeds around the periphery of the first disk may further include orbiting two or more first rollers and the method may further include increasing, after stopping the movement of the two or more first rollers, the pressure of another portion of the fluid in the tubing between another first roller of the two or more first rollers and another second roller of the plurality of second rollers by causing the two or more first rollers to orbit at a fourth angular speed while the other first roller moves along and fully compresses the tubing in the first section of the periphery of the first disk, and by simultaneously causing the other second roller to move along and fully compress the tubing in the first section of the periphery of the second disk. In such embodiments, the fourth angular speed may be different than the second angular speed and may also be greater than the second angular speed.

In some other such embodiments, orbiting one or more first rollers at two or more angular speeds around the periphery of the first disk may further include orbiting two or more first rollers and the method may further include increasing, after stopping the movement of the two or more first rollers, the pressure of another portion of the fluid in the tubing between another first roller of the two or more first rollers and another second roller of the plurality of second rollers by causing the two or more first rollers to orbit at a fifth angular speed while the other first roller moves along and fully compresses the tubing in a fourth section of the periphery of the first disk, and by simultaneously causing the other second roller to move along and fully compress the tubing in a fourth section of the periphery of the second disk. In such embodiments, the fifth angular speed may be different than the first angular speed and may also be greater than the second angular speed.

In some embodiments, increasing the pressure of the portion of the fluid in the tubing between the one first roller and the one second roller may account for air bubbles in the tubing between the one first roller and the one second roller.

In some such embodiments, the method may further include identifying intervals with a heightened probability of having air bubbles in the tubing.

In some embodiments, moving the portion of the fluid through the tubing at a constant pressure towards an output of the tubing may further include causing, after the one first roller has moved along the second section of the periphery of the first disk, the one first roller to move along a third section of the periphery of the first disk, the one first roller to fully compress the tubing at at least the beginning of the third section of the periphery of the first disk, and the one first roller to not fully compress the tubing at at least the end of the third section of the periphery of the first disk; and causing another second roller of the plurality of second rollers to fully compress the tubing against the second disk before causing the one first roller to not fully compress the tubing at at least the end of the third section of the periphery of the first disk.

In one embodiment, a system may be provided. The system may include a first disk that may be substantially circular, may have a nominal radius, and may include a first recess in the periphery of the first disk, the first recess configured to receive a first portion of tubing for conveying fluid; a second disk that may be substantially circular, may have substantially the nominal radius, and may include a second recess in the periphery of the second disk, the second recess configured to receive a second portion of the tubing; one or more first rollers that may be configured to orbit around the periphery of the first disk such that each of the one or more first rollers travels at the same angular speed as the other first rollers and that are configured to press into contact with the periphery of the first disk, the first portion of the tubing, or the periphery of the first disk and the first portion of the tubing; a first motor that may be configured to cause the one or more first rollers to orbit the periphery of the first disk at two or more angular speeds; a plurality of second rollers that may be configured to orbit around the periphery of the second disk and configured to press into contact with the periphery of the second disk, the second portion of the tubing, or the periphery of the second disk and the second portion of the tubing; a second motor that may be configured to cause the plurality of second rollers to orbit the periphery of the second disk at a constant angular speed; and a controller for controlling the system. The controller may include control logic for controlling the first motor to cause the one or more first rollers to orbit around the periphery of the first disk at a first angular speed and a second angular speed that is less than the first angular speed, controlling the second motor to cause the plurality of second rollers to orbit around the periphery of the second disk at the second angular speed, increasing the pressure of a portion of the fluid in the tubing between one first roller of the at least one first roller and one second roller of the plurality of second rollers by controlling the first motor to cause the one or more first rollers to orbit at the first angular speed so that the one first roller moves along and fully compresses the tubing through a first section of the periphery of the first disk, and by simultaneously controlling the second motor to cause the one second roller to orbit the second disk at the second angular speed and move along and fully compress the tubing in a first section of the periphery of the second disk, and moving, after increasing the pressure of the portion of the fluid, the portion of the fluid through the tubing at a constant pressure towards an output of the tubing by controlling the first motor to cause the one or more first rollers to orbit the first disk at the second angular speed while the one first roller moves along and is fully compressing the tubing in a second section of the first disk, while the one second roller is fully compressing the tubing.

In some embodiments, the controller may further include control logic for identifying intervals with a heightened probability of having air bubbles in the tubing, and increasing, by controlling the first motor to cause the first angular speed to increase, the pressure of the portion of the fluid in the tubing between the one first roller and the one second roller to account for air bubbles in the tubing between the one first roller and the one second roller.

In some such embodiments, the system may further include a sensor configured to provide data indicative of a heightened probability of air bubbles in the tubing.

In some embodiments, the controller may further include control logic for determining the location of each of the first rollers relative to the first disk and the location of each of the second rollers relative to the second disk.

In some embodiments, the controller may further include control logic for determining the pressure in the tubing from a pressure sensor that is in fluidic communication with the tubing.

In some embodiments, the controller may further include control logic for controlling the first motor to stop the movement of the one or more first rollers.

BRIEF DESCRIPTION OF THE DRAWINGS

FIGS. 7A-7C depict a handoff of fluid between the first stage and the second stage of the peristaltic pump.

DETAILED DESCRIPTION

Figure 1:
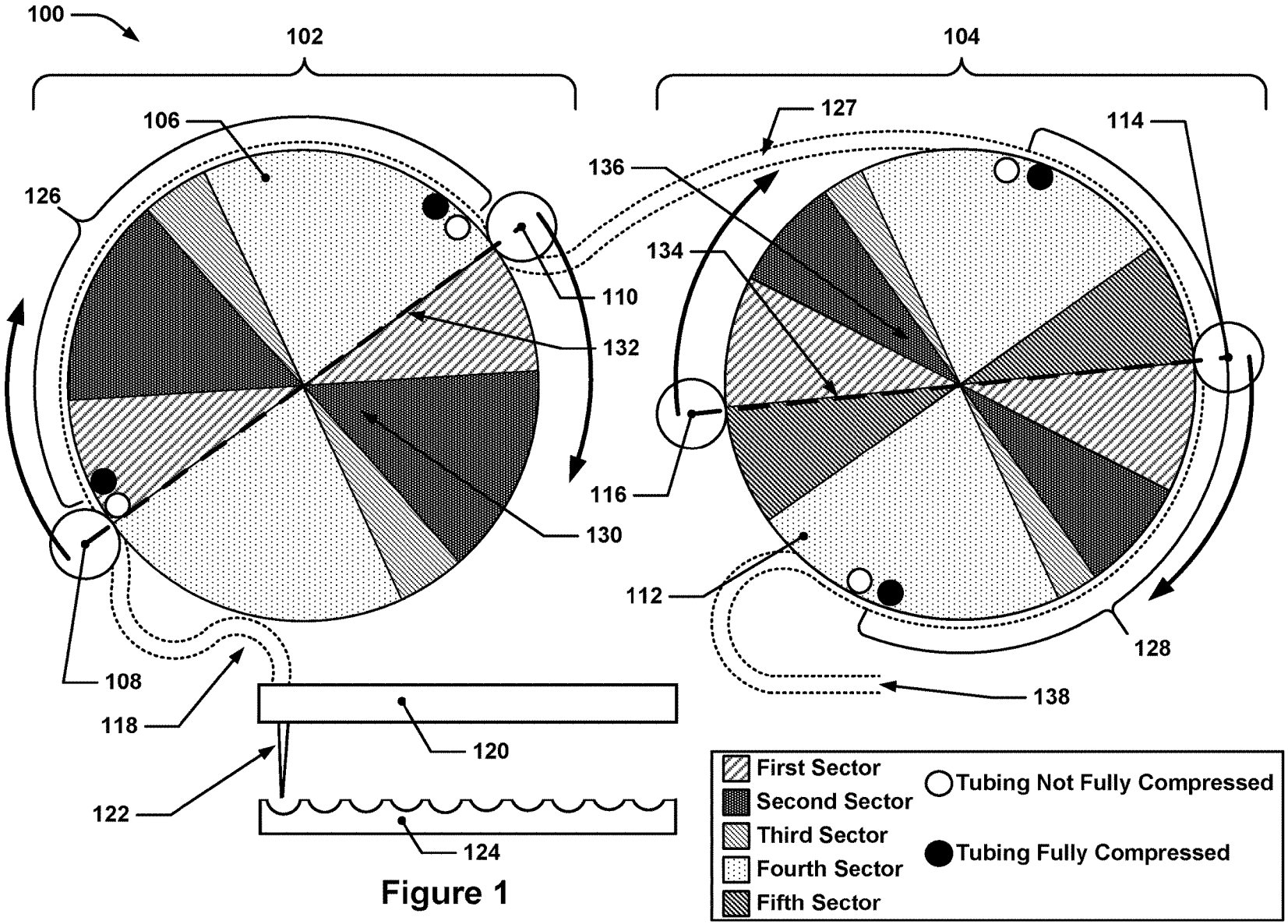
FIG. 1 is a schematic illustration of an example two-stage peristaltic pump.

In flow cytometry equipment, peristaltic pumps are used to pump sample fluids from sample vessels or other sources and through a cuvette or into a nozzle for analysis. In a cuvette-based system, the sample stream is hydrodynamically focused within a sheath fluid so that the sample stream is a constant width as it flows through the cuvette (where it is illuminated by lasers that are focused on a particular location). In a nozzle-based system, the sample stream is also hydrodynamically focused before being jetted out of the nozzle to form a droplet stream; it is important to keep the sample stream a constant width in the nozzle context so that the timing of droplet formation remains predictable and constant. Conventional, single-stage peristaltic pumps may cause pulsations in the pumped fluid that cause the width of a hydrodynamically focused fluid stream to vary with time, thereby making the fluid flow rate non-uniform. This can cause the flow cytometry system to be less accurate, thereby negatively affecting performance.

In a peristaltic pump, it is generally desirable to have at least two rollers evenly spaced apart about the circumference of a cam or disk; these rollers may be caused to orbit the cam or disk. The tubing of the peristaltic pump may be routed around the cam or disk such that the rollers compress and release the tubing as they orbit around the cam or disk. When the tubing is compressed by a roller, the roller will cause the fluid in the tubing to be pushed ahead of the roller. The fluid behind the roller will be at a pressure generally governed by the upstream pressure of the fluid, e.g., the fluid source pressure, and the fluid ahead of the roller will be at a pressure generally governed by the downstream pressure of the fluid, e.g., the back pressure.

Generally speaking, it is always desirable in a single-cam or single-disk peristaltic pump to have at least one roller fully compressing the tubing during all stages of operation—if there are any points in time when a roller is not fully compressing the tubing, the back pressure in the system may cause the fluid to travel backwards through the pump before being driven forwards again due to the compression on the tubing caused by the next roller to fully compress the tubing.

In a single-cam or single-disk peristaltic pump, pressure pulsations in the pumped fluid may result each time the leading roller stops fully compressing the tubing—this is because the fluid that was trapped behind the roller may become fluidically united with the fluid that was pushed ahead of the roller, thereby allowing the pressures of the two portions of fluid to equalize. Since the fluid being driven ahead of the roller is typically at a higher pressure than the fluid that follows the roller, this causes the pressure in the downstream fluid to drop slightly, which causes pulsations in pressure.

Some peristaltic pumps attempt to reduce the pulsation by using three or more rollers to average out or smooth out the pulsations, but the additional rollers decrease the lifespan of the flexible tubing of the peristaltic pump thereby leading to increased maintenance costs and pump downtime. For example, the tubing will experience 50% more wear and tear with three rollers instead of two.

In view of the issue with pulsation in the flow cytometry context, a substantially constant output pressure is desirable in many flow cytometry applications. The pulsing of the output liquid from a conventional peristaltic pump may be acceptable in many instruments and other applications. However, it would be much more desirable to have a substantially constant pressure output that does not pulse in many other applications of a peristaltic pump, e.g., in flow cytometers.

While other types of pump technology may offer more uniform pumping, such as air compression pumps or syringe pumps, there may be reasons why such alternatives may be undesirable. For example, because samples in flow cytometry may be taken from small volume containers, such as a 5 milliliter tube or 96-well plate, it is more difficult and complex to use an air compression pump that utilizes a seal with such containers. Syringe pumps may also be used for flow cytometry, but such pumps are slow, have functional problems, are difficult to clean out or de-clog, and are unable to effectively draw samples of varying media and/or varying volumes.

The present inventors conceived of a new type of peristaltic pump that provides for generally constant pressure output and that eliminates most or all of the pulsative behavior of conventional peristaltic pumps discussed above. Such improved peristaltic pumps may feature two stages—one in which the fluid is intermittently pressurized to the desired output pressure, and a second in which the pressurized fluid is then moved at a constant flow rate to an output of the pump. Generally speaking, the rollers in the second stage of such a two-stage peristaltic pump may orbit around a disk or cam of the second stage at a constant angular velocity, whereas the roller or rollers of the first stage may orbit around a disk or cam of the first stage with a varying angular speed that varies so as to be faster than, slower than, and equivalent to the constant angular velocity of the rollers in the second within certain sectors of the disk or cam of the first stage. Such embodiments are discussed in more detail below.

FIG. 1 is a schematic illustration of an example two-stage peristaltic pump. As can be seen in FIG. 1, the two-stage peristaltic pump 100 (which also may be referred to herein as a "pump" or "peristaltic pump") includes a first stage 102 and a second stage 104. The first stage 102 includes a first disk 106 that is substantially circular (e.g., within +/−10% of round) with a first radius and with two first rollers, first roller 108 and first roller 110. The second stage 104 includes a second disk 112 that is substantially circular (e.g., within +/−10% of round) with substantially the same first radius as the first disk 106 such that the first disk 106 and the second disk 112 are substantially the same diameter; the second disk 112 also includes two second rollers, the second roller 114 and the second roller 116.

The two-stage peristaltic pump of FIG. 1 also includes tubing that may be used to transport fluid throughout the two-stage peristaltic pump 100 and may be located on portions of the first disk 106 and the second disk 112. The word "tubing," as used herein, may refer to discrete sections of tubing that are joined together, e.g., via couplers, or a single length of unbroken tubing; it may also refer to different portions of such structures. Part of the tubing may include an intake tubing 118, that can be seen in the lower left portion of FIG. 1, that may be connected to a fluid source through a sample uptake apparatus, such as a liquid handling machine like an autoloader 120 having an uptake probe 122 (i.e., a pipette). The autoloader 120 may move the uptake probe 122 to multiple fluid sources, such as each well of a well plate 124 (e.g., a 96-well plate or other media and containers like a cuvette) to obtain biological samples that are then pumped through the peristaltic pump 100. As discussed in more detail below, air that may be drawn into the intake tubing 118 by the movement of the uptake probe when it is not in a fluid and the peristaltic pump is operating may, in some implementations, be accounted for by the peristaltic pump 100.

Other sections of the tubing may be wrapped around a portion of the first disk, e.g., tubing 126, and around a portion of the second disk, e.g., tubing 128; an interconnect section of tubing may span between tubing 126 and 128, e.g., tubing 127 (also may be referred to as "interconnect tube," "interconnect tubing," or "interconnecting tubing"). For instance, the tubing of the peristaltic pump in FIG. 1 includes intake tubing 118, tubing 126 that is wrapped around a portion of the first disk 106, tubing 128 that is wrapped around a portion of the second disk 112, interconnect tubing 127 that fluidically connects tubing 126 and tubing 128, and an output 138 (which also may be referred to herein as "output tubing"), all of which are fluidically connected with each other. In this particular implementation, the tubing is continuous, but such tubing may also, as noted above, be composed of discrete segments that are joined together. For example, the interconnect tubing could, alternatively, be at least partially replaced by a rigid fitting or tube. It should be noted that FIG. 1 is one example embodiment of a peristaltic pump and that such a peristaltic pump may be used in contexts aside from a flow cytometer, such as accurate continuous sample dispensing, accurate continuous sample disposition, accurate continuous sample disposition, continuous washing, metering of a mixing fluid into a pressurized stream, and metered mixing of a reagent into a sample during delivery.

Referring back to FIG. 1, the first rollers 106, 108 may be configured to orbit around the first disk 106, in tandem, at various angular speeds with respect to the first disk 106; the movement of the first rollers are synchronized such that each of the first rollers travels at substantially the same angular speed around the first disk 106 at the same time as the other first roller (or rollers, if more than two first rollers are used), and that this synchronized angular speed is variable. For example, if the first roller 108 is orbiting at a first angular speed, the first roller 110 is simultaneously orbiting at substantially that first angular speed. If the first roller 108 is then slowed down to orbit at a second angular speed, the first roller 110 is concurrently slowed down to orbit at the second angular speed.

It should be noted that such orbiting of rollers (i.e., the first and the second rollers) may also be referred to herein as the rollers rotating around or about the first disk; such orbiting also means the movement of rollers around, or encircling, the periphery of a disk. Such orbiting or movement around the periphery of a disk is not intended refer to the rotation of each roller around each roller's individual pivot point, as discussed below, although the rollers may typically rotate about their own centers as they orbit the disk and roll along the periphery of the disk. Therefore, as each roller orbits around the periphery of the disk, each roller is also simultaneously rotating about its own pivot point. It is also to be understood that the term "orbit" is used herein to refer to motion that may not be a complete orbit. For example, a roller may travel at different speeds as it makes a complete orbit around a disk—in such a case, the roller, for example, may be said to orbit the disk at a first speed and then orbit the disk at a second speed. For example, the roller may orbit the disk at the first speed through an orbital arc with an included angle of 45 degrees, and may orbit the disk at the second speed through an orbital arc with an included angle of 90 degrees.

Referring back to FIG. 1, the first rollers may each be attached to a first roller support, which is represented in FIG. 1 by dashed line 132. The first roller support 132 may be a single support arm with a single center pivot point that is connected to a motor that is configured to rotate the support arm 132 at various angular speeds such that each of the first roller 108, 110 travels at the same angular speed as the other first roller, but such angular speed may differ as the support arm 132 is rotated through a full 360° rotation, as noted above. Each of the first rollers may also be attached to a roller bracket (not shown) on the support arm 132 that may enable the first rollers 108, 110 to be biased against, e.g., pressed into contact with, the periphery of the first disk 106, tubing 126, or the periphery of the first disk 106 and tubing 126 while the first rollers 106, 108 to rotate around the first disk 106 in a clockwise direction, as illustrated by arrow 130. An example roller bracket is described in the aforementioned U.S. application Ser. No. 15/242,122, and such discussion thereof is hereby incorporated by reference in its entirety. The first rollers 108, 110 may be forced against the periphery of the first disk 106 by springs in the roller brackets so that the flexible tubing 126 is compressed against the first disk 106 in locations where the flexible tubing 126 is exposed to rollers 108, 110. The roller brackets may pivot around pivots that are mounted on the roller support 132. The first rollers 108, 110 rotate about their own center points as they roll along the outer periphery of the first disk 106 during their orbits of the first disk 106.

Because the radius of the first disk 106 is substantially circular, it has a substantially constant radius and substantially circular periphery. Accordingly, each of the first rollers travels at substantially the same angular speed and tangential speed as the other first roller(s) (e.g., within +/−5%). There may be some minor variation in tangential speed of the rollers due, for example, to shifts in roller position due to the amount of tubing compression by the rollers; generally speaking, however, the rollers will be kept at the same nominal speed. Similarly, because the radius of the second disk 112 is substantially circular, it has a substantially constant radius and substantially circular periphery and therefore, each second roller travels at substantially the same angular and tangential speed as the other second roller(s). In some embodiments, such as that in FIG. 1, the radii of the first disk 106 and the second disk 112 are substantially the same such that when the first rollers 108, 110 are traveling at a first angular speed and the second rollers 114, 116 are traveling at substantially the first angular speed, the first rollers 108, 110 and the second rollers 114, 116 are all moving at substantially the same angular speed and tangential speed.

As noted above and discussed in greater detail below, the first rollers 108, 110 orbit around the periphery of the first disk 106 at two or more angular speeds. During each such orbit, each roller is caused to contact the periphery of the first disk 106, the tubing 126, or the periphery of the first disk 106 and the tubing 126, such that in various locations around the periphery of the first disk 106 one or more of the first rollers fully compresses the tubing 126. As indicated by arrow 130 in FIG. 1, the first rollers rotate in a clockwise direction in the depicted implementation. For example, as seen in FIG. 1, the flexible tubing 126 is wrapped around a portion of the outside perimeter, i.e., the periphery, of the first disk 106. As illustrated in more detail below with respect to FIGS. 11-14, the flexible tubing 126 is positioned in a recess, i.e., a trough, such that in at least a certain portion of the periphery of the first disk 106, the tubing 126 extends past the periphery of the first disk 106 to enable the first rollers 108, 110 that orbit, i.e., rotate, around the periphery of the first disk 106 to compress the flexible tubing 126 in such locations; such compression of the tubing by the first rollers 108, 110, depends upon the depth of the trough or placement of the adjustment plate, as explained in more detail below.

FIG. 1 also includes a legend in the bottom right corner depicting two various compression states of the tubing 126. This legend is used in FIGS. 2-8 and 10. As discussed in more detail below, the tubing may be fully compressed such that no fluid may pass through the tubing ("full compression" of the tubing, as discussed herein, does not mean that the tubing is squashed to zero thickness, just that it is compressed sufficiently to prevent fluid from flowing through the tubing at the point of compression), and not fully compressed such that fluid may pass through the tubing; when the tubing is not fully compressed it may be partially compressed or not compressed at all. A small circle without shading indicates that the tubing is not fully compressed while a small circle with shading indicates that the tubing is fully compressed. Such compression status indicators are located within each disk in FIG. 1 and represent changes in the compression status of the tubing based upon the location of the roller. For instance, when a roller is between two non-shaded circles, the tubing is not fully compressed by that roller and when a roller is between two shaded circles, the tubing is fully compressed by that roller. For example, in FIG. 1 the first roller 108 and the first roller 110 are both not fully compressing the tubing, the second roller 116 is not fully compressing tubing 128, and the second roller 114 is fully compressing tubing 128 (as discussed in more detail below, tubing 128 is wrapped partially around the periphery of the second disk 112).

Additionally, as discussed below, when fluid in the tubing is trapped between a first roller and a second roller, and the rear roller, i.e., the first roller, is moving at a greater angular speed than the front roller, i.e., the second roller, the length of the tubing containing the fluid is decreased, but because the fluid is incompressible, the volume of the fluid remains constant and forces the tubing to expand to accommodate this fluid volume which in turn increases the pressure of the trapped fluid in the tubing between these two rollers. It is this process that is used by the peristaltic pump disclosed herein to increase the pressure of a fluid flowing through the pump. Additionally, if air is trapped in this volume, the compression of this air is also used to increase the pressure of the trapped fluid.

FIG. 1 also depicts the second stage 104 of the peristaltic pump. As can be seen, the second stage 104 includes the second disk 112 and the second rollers 114 and 116, and second roller support 134 on which the second rollers 114, 116 may be mounted. As depicted in FIG. 1, the second roller support 134 is also configured to rotate in a clockwise direction around the second disk 112, as illustrated by second arrow 136; in contrast to the first rollers, the orbit (e.g., rotation of the second roller support 134) is at a constant angular speed. The second roller support 134 may be configured (e.g., connected to motor different than the motor to which the first roller support 132 may be connected) to travel at a constant angular speed while the first roller support 132 is configured to travel at variable angular speeds.

Similar to the first stage 102, the flexible tubing 128 is wrapped around a portion of the outside perimeter, i.e., the periphery, of the second disk 112. Again, as illustrated in more detail below with respect to FIGS. 11-14, the flexible tubing 128 is positioned in a recess or trough such that in at least a certain portion around the periphery of the second disk 112, the tubing 128 extends past the periphery of the second disk 112 to enable the second rollers 114, 116 that orbit around the periphery of the second disk 112 to compress the flexible tubing 128 in such locations; such compression of the tubing by the second rollers 114, 116, depends upon the depth of the trough or placement of the adjustment plate.

In some embodiments, FIG. 1 may be considered to illustrate both the first stage 102 and the second stage 104 from top perspectives. Accordingly, both the first stage 102 and the second stage 104 have roller supports that may be rotating in the same direction, like the clockwise direction, when viewed from the top. In other implementations, one of the stages may be flipped and may have a roller support that rotates in an opposite direction from the roller support of the other stage.

Similar to the first stage 102, the second rollers 114, 116 may be mounted on roller brackets and are biased against the outer periphery of the second disk 112 by springs. As the second roller support 134 rotates the second rollers 114, 116 in the clockwise direction, the second rollers 114, 116 roll along the periphery of the second disk 112 and rotate around pivot points, thereby squeezing or compressing the flexible tubing 128 at locations along the periphery of the second disk 112 where the flexible tubing 128 is exposed to the surface of the second rollers 114, 116. The fluid in tubing 128 that is in front of a second roller, i.e., located on the side of the second roller further from the tubing inlet, is pumped by the second stage 104 by the rotation of the second roller support 134 around the second disk 112 to move the second rollers 114, 116 such that the fluid moves through the flexible tubing 128 around the periphery of the second disk 112 until the fluid exits the output 138 of the tubing, which may be connected to a flow cell in a flow cytometer or a nozzle of a flow cytometer, or other fluid-receiving system. The fluid may be pumped into any device for use and does not necessarily need to be pumped into a flow cytometer. The fluid in the second stage 104 that is in front of each of the second rollers 114, 116 (e.g., being pushed by each second roller) is not subjected to a pressure increase (when the first stage pressurizes the fluid to the same pressure as the downstream pressure at the output 138 of the tubing), but is simply moved towards the output of the tubing at a constant pressure. Back pressure of the system to which the fluid is being applied assists in maintaining a substantially constant pressure of the fluid pumped from the second stage.

As noted above, the second rollers 114, 116 are biased against (i.e., constantly pressed into contact with) the periphery of the second disk 112, tubing 128, or the periphery of the second disk 112 and tubing 128, depending on the circumferential positions of the second rollers at any given time. Furthermore, because the second rollers 114, 116 move at substantially the same angular speed around the periphery of the second disk 112, the pressure of the pumped fluid (e.g., the fluid that is pushed by each second roller 114, 116 towards the output 138 of the tubing) remains substantially the same as the fluid is pushed around the second disk 112.

Moreover, fluid from intake tubing 118 is drawn into the flexible tubing 126 as the first rollers 108, 110 move in the clockwise direction and fully compress the flexible tubing 126. Fluid is thus drawn from the intake tubing 118 and is forced out of the interconnecting tubing 127 and proceeds to the second stage 104.

Figure 2:
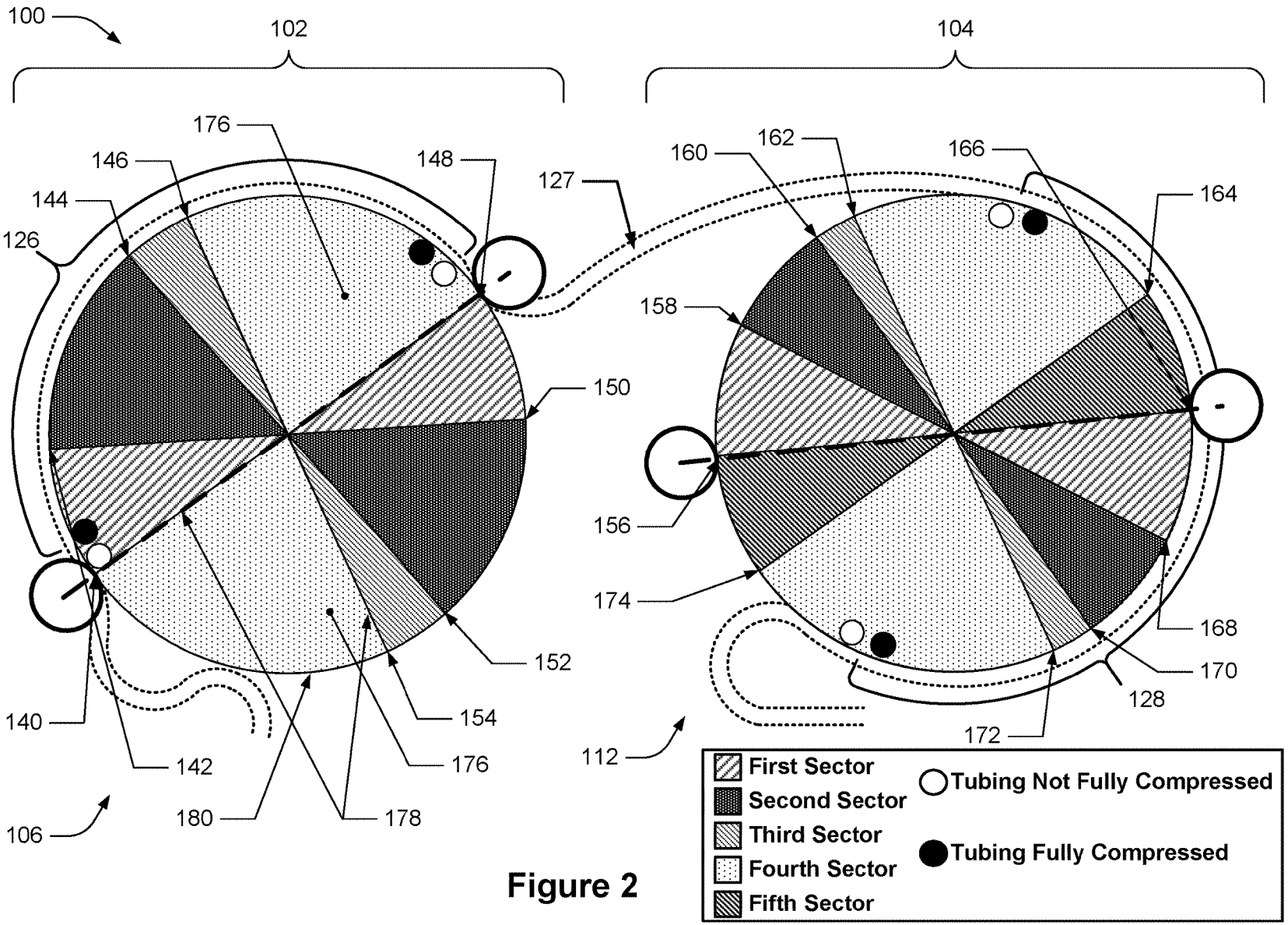
FIG. 2 depicts the first stage and second stage of FIG. 1 with particular positions identified around each disk.

FIG. 1 also depicts each disk being partitioned into multiple pairs of opposing sectors, each pair indicated by different shading or crosshatching as also shown in the legend in FIG. 1, and FIG. 2 depicts the first stage and second stage of FIG. 1 with particular positions identified around each disk. As discussed in more detail below, these sectors and positions are used to explain and demonstrate the operation of the peristaltic pump 100. A "sector" of a disk is a portion of the disk bounded by two radii of the disk and the arc between the radii. Each position corresponds to a point location on the periphery of each disk between the indicated sectors. For example, in FIG. 2 the first disk 106 includes four pairs of substantially identical sectors; each pair of sectors is identically shaded or crosshatched, although only one sector of each pair is labeled to avoid undue visual clutter.

FIGS. 3 through 10 illustrate the operation of the first stage 102 and the second stage 104 of the peristaltic pump 100 as the first rollers 108, 110 and the second rollers 114, 116 proceed around, i.e., orbit, the peripheries of the first disk 106 and the second disk 112. Each Figure represents the movements of the rollers in the two stages 102 and 104 of the peristaltic pump over a period of time.

Figure 3:
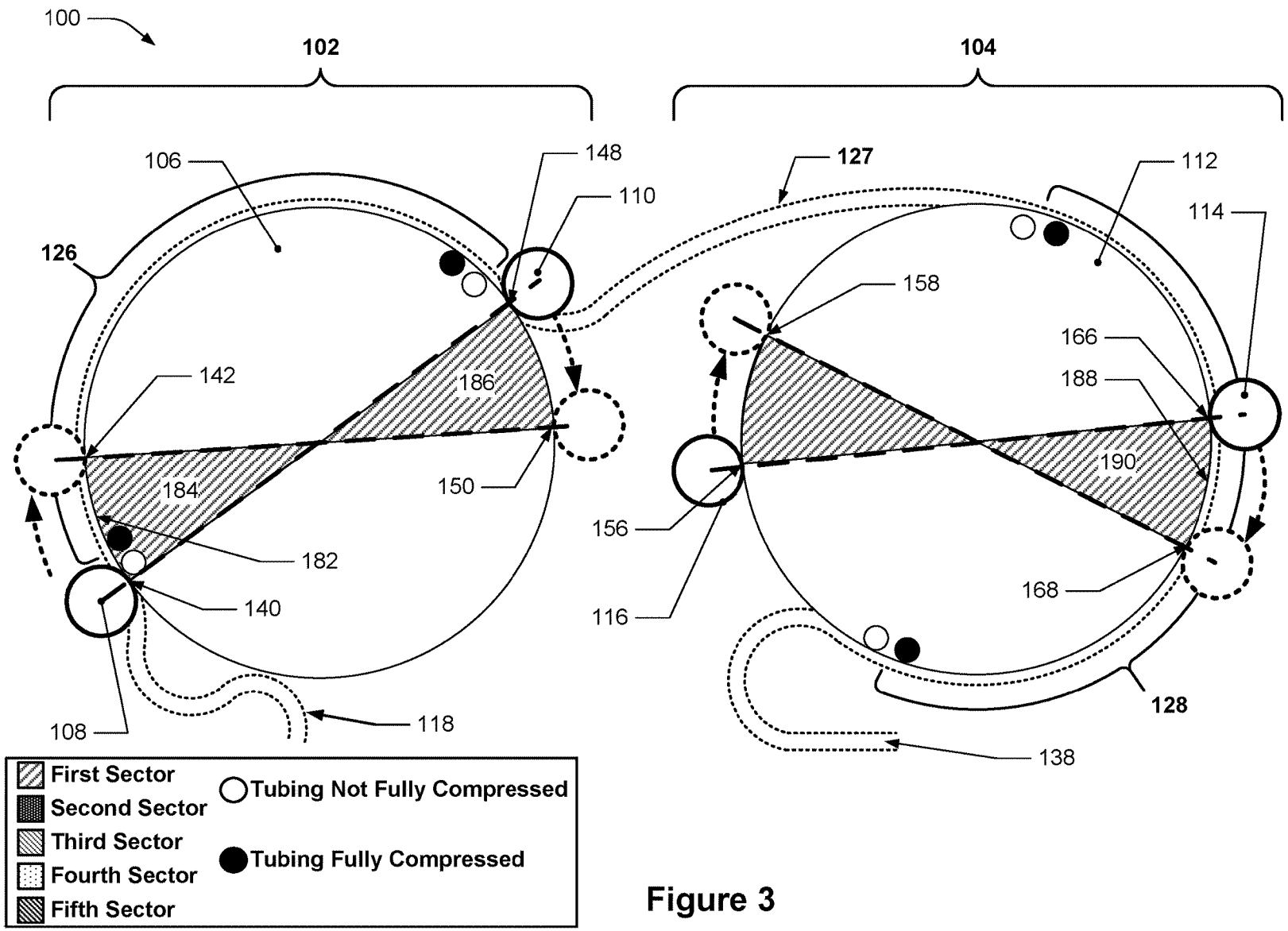
FIG. 3 depicts the peristaltic pump of FIG. 1 with the first rollers orbiting through a first sector of the first disk and the second rollers simultaneously orbiting through a first sector of the second disk.

FIG. 3 depicts the peristaltic pump of FIG. 1 with the first rollers orbiting through a first sector of the first disk and the second rollers simultaneously orbiting through a first sector of the second disk. As can be seen, the first roller 108 begins at position 140 of the first disk 106 and moves along a section 182 of the periphery of the first disk 106 to position 142. The first roller 108 may move along the section 182 at a constant angular speed or, in some embodiments, at a variable angular speed, such that it may be accelerating or decelerating during some or all of this first sector. The direction of movement of the first roller 108 is indicated by the dashed arrow, e.g., clockwise in FIG. 3. It is to be understood that the directionality of the roller movement in the two stages is somewhat arbitrary and dependent on how the stages are arranged—in both stages, however, the rollers for each stage will move in directions that cause the rollers to travel along the tubing towards the output end of the tubing.

As indicated by the aforementioned shaded and non-shaded circles in the interior of the first disk 106, at position 140, the first roller 108 is not fully compressing the tubing 126 and transitions to fully compressing the tubing 126 at some position in the first sector 184 (i.e., some position along the section 182).

As stated above, the first rollers 108 and 110 are configured to travel simultaneously at the same angular speed such that the movement of the first roller 108 is simultaneously mirrored by the first roller 110. Therefore, as the first roller 108 moves along a section 182 of the periphery of the first disk 182 within the first sector 184 to position 142, the first roller 110 simultaneously moves along the section of the periphery of the first disk 106 within the opposing first sector 186 from position 148 to position 150 such that the first roller 110 travels substantially the same tangential distance as the first roller 108 and substantially the same tangential and angular speeds as first roller 108.

As can be seen further in FIG. 3, as the first roller 110 moves along the section of the periphery of the first disk 106 from position 148 to position 150, the first roller 110 is not fully compressing the tubing 126. Moreover, when the first roller 108 is at position 140 and the first roller 110 is at position 148, tubing 126 is not fully compressed by either of first rollers 108 or 110.

Referring to the second stage 104 of FIG. 3, while the first rollers 108, 110 are moving along the peripheries of the first sectors 184 and 186 of the first stage, respectively, the second rollers 114, 116 are orbiting the second disk 112 at a constant angular speed. For instance, the second roller 114 moves in a clockwise direction, as indicated by the dashed arrow, from position 166 to position 168 along a section 188 of the periphery of the second disk within the first sector 190 of the second disk 112. The second roller 114 may move along the section 188 of the periphery of the second disk 112 within the first sector 190 at a constant angular speed.

As described above, the second rollers 114, 116 may be configured such that they both constantly orbit at the same angular speed and may be located at opposite points on the second disk 112, e.g., separated from each other by 180 degrees about the disk center. Therefore, as the second roller 114 moves along the periphery of first sector 190, the second roller 116 simultaneously moves along the periphery of an opposing first sector that mirrors the first sector 190. Accordingly, when the second roller 116 is at position 156, the second roller 114 is at position 166, and the second roller 116 then moves from position 156 to position 158 along a substantially identical section of the periphery of the second disk 112 as section 188 of the periphery of the second disk 112 and at substantially the same angular speed as the second roller 114.

Referring to the legend in FIG. 3, the second roller 114 is fully compressing the tubing 128 as it moves along the section 188 of the periphery of the second disk 112 within the first sector 190 while, during this same movement, the second roller 116 is not fully compressing the tubing 128 as it travels along an opposite section of the second disk 112. As disclosed herein, the second rollers 114, 116 are orbited at the same angular speed through the first sector 190 and through all of the other sectors of the second disk 112.

In some embodiments, the first rollers may orbit around a part of the first disk at the same angular speed as the second rollers orbit around the second disk such that the first rollers and the second rollers traverse equivalent sections of their respective disks. For example, FIG. 3 may show this synchronization between the first rollers and the second rollers. Here in FIG. 3, the first roller 108 is at position 140 at substantially the same time (e.g., within +/−5% of each other) that the second roller 114 is at position 166 and if the first roller 108 moves from position 140 to position 142 along the section 182 at the same angular speed as the second roller 114, then the first roller 108 will reach position 142 at substantially the same time as when the second roller 114 reaches position 168, and each of these two rollers will have traveled sections of the periphery of their respective disk that are substantially the same, e.g., the section 182 is substantially the same as the section 188. In such situations, the sectors traveled by the first rollers and the second rollers will also be the same, e.g., the first sector 184 will be substantially the same as first sector 190.

As fluid is drawn into the tubing 126, fluid becomes trapped between a first roller and a second roller when these rollers are fully compressing the tubing. For instance, referring to FIG. 3, once roller 108 fully compresses the tubing 126 between positions 140 and 142, fluid in tubing 126, interconnect tubing 127, and tubing 128 between the first roller 108 and the second roller 114 becomes trapped because both rollers are fully compressing the tubing and preventing fluid from escaping. Accordingly, once this fluid is trapped, the fluid is moved by the first roller 108 and the second roller 114 towards the output tubing 138 through the interconnecting tubing 127 and through the tubing 128.

As stated above, when the first roller 108 moves from position 140 to position 142, and after it is fully compressing the tubing 126 and is moving at the same angular speed as the second roller 114, the first roller 108 pushes (and the second roller 114 pulls at the same rate) and causes the fluid in the tubing 126 to move towards the second disk 112 without increasing the pressure of the fluid trapped between the first roller 108 and the second roller 114 as they move between these positions (i.e., 140 to 142 and 166 to 168, respectively).

In some such situations, the fluid in the tubing between a first roller fully compressing the tubing and a second roller fully compressing the tubing will not be subjected to a pressure increase. For example, referring to FIG. 3, the pressure in the tubing 126 between the first roller 108, once it is fully compressing tubing 126 after position 140, and the second roller 114, which is fully compressing tubing 128 between positions 166 and 168, will remain substantially constant so long as the first roller 108 and the second roller 114 move at the same angular speed.

Figure 4:
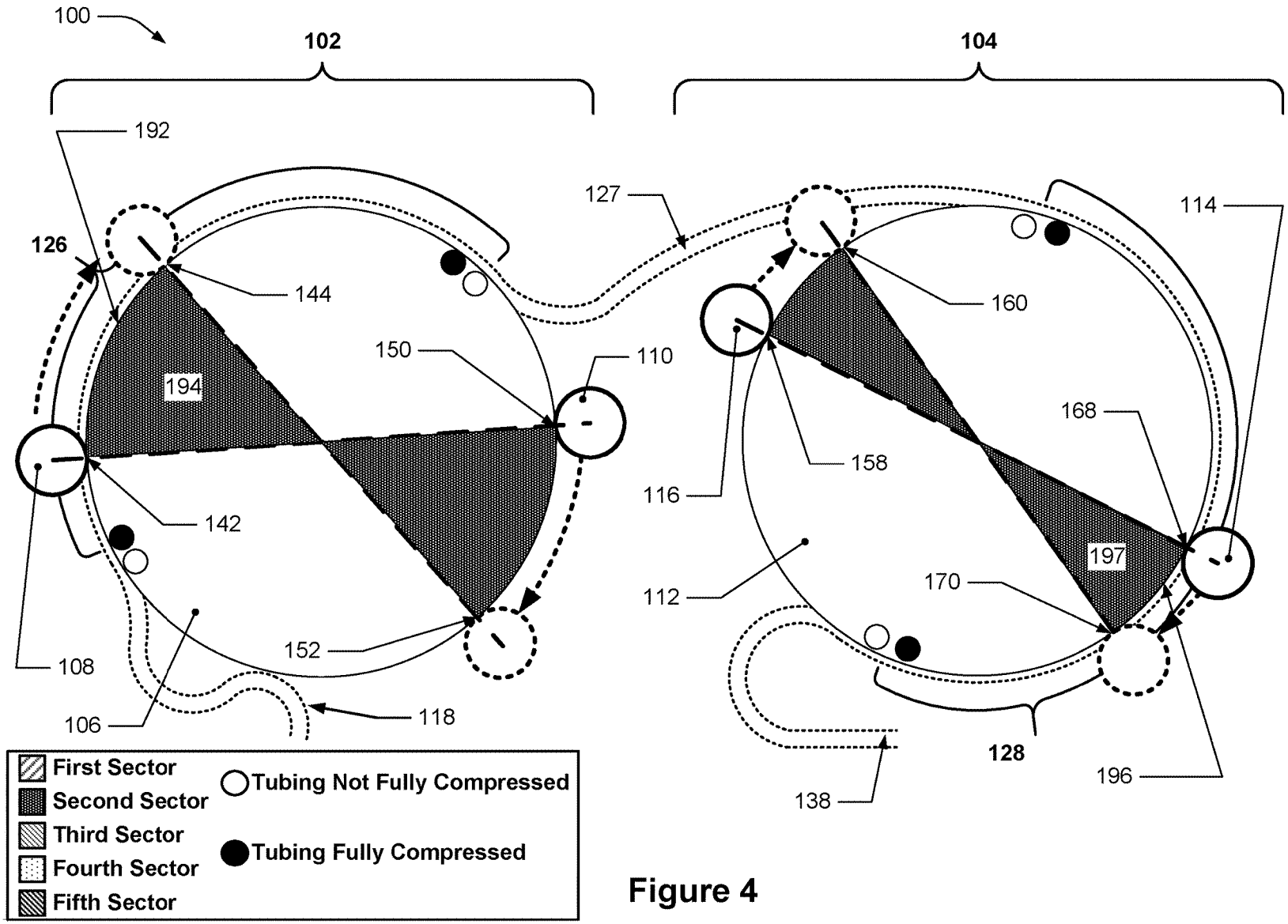
FIG. 4 depicts the peristaltic pump of FIG. 1 with the first rollers orbiting through a second sector of the first disk and the second rollers simultaneously orbiting through a second sector of the second disk.

The peristaltic pump disclosed herein is configured not only to pump fluid through the tubing, but also to increase the pressure of fluid within the tubing prior to moving the fluid through the second stage. For instance, the pressure of fluid trapped in between a first roller fully compressing the tubing and a second roller fully compressing the tubing may be increased by increasing the angular speed of the first rollers to an angular speed greater than the angular speed of the second rollers. FIG. 4 depicts the peristaltic pump of FIG. 1 with the first rollers orbiting through a second sector of the first disk and the second rollers simultaneously orbiting through a second sector of the second disk. Referring first to the first stage 102 in FIG. 4, the first roller 108 moves along a section 192 of the periphery of the first disk 106 within a second sector 194 of the first disk 106, i.e., from position 142 to position 144, while fully compressing the tubing 126. The first roller 108 moves along the section 192 at an angular speed that is greater than the angular speed of the second rollers 114, 116 as they orbit around the second disk 112 and that is greater than the angular speed at which the first rollers 108, 110 moved in the first sectors (e.g., along the section 182 of the periphery of the first disk 106 between positions 140 and 142).

The first roller 110 moves in a substantially identical, synchronized manner in a substantially identical second sector of the first disk 106, but at a different location, as seen in FIG. 4 by the identically sized and shaded second sector opposite the second sector 194 (i.e., movement along a section of the periphery of the first disk 106 between positions 150 and 152 of the first disk); the first roller 110 is not compressing the tubing 126 during this movement.

The change in angular speed of the first rollers 108, 110 may be accomplished by increasing the angular speed at which the first rollers 108, 110 orbit around the substantially circular first disk 106, such as by increasing or decreasing the speed of a motor that causes the first rollers 108, 110 to orbit around the first disk 106. A separate motor may be used to drive the second rollers 114, 116 around the second disk 112 independently of the movement of the first rollers 108, 110.

Referring to the second stage 104 in FIG. 4, the second roller 114 moves along a section 196 of the periphery of the second disk 112 within a second sector 197 of the second disk 112, i.e., from position 168 to position 170 of the second disk 112 while fully compressing tubing 128. The second roller 116 is not compressing the tubing 128 during its simultaneous movement between positions 158 and 160 of the second disk 112.

As depicted in FIG. 4, the second roller 114 moves from position 168 to position 170 of the second disk 112 at the same time that the first roller moves from position 142 to position 144. Because the first roller 108 moves at a faster angular speed, and therefore also a faster tangential speed, than the second roller 114 during this period, the first roller 108 travels a greater tangential distance along the periphery of the first disk 106 than the second roller 114 does about the periphery of the second disk 112 during this same time. Accordingly, the section 192 of the periphery of the first disk is greater than section 196 of the periphery of the second disk 196.

Furthermore, it is this difference in angular speeds between a first roller and a second roller that causes a pressure increase of the fluid that is trapped between that first roller and that second roller. As mentioned above, the peristaltic pump disclosed herein increases the pressure of a portion of fluid in the tubing between a first roller and a second roller by causing that first roller to move at a faster angular speed around the first disk than the angular speed of second roller around the second disk. Again, this pressure increase is caused by the first roller outracing the second roller, thereby decreasing the length of tubing between the two rollers that contains a fixed volume of fluid, which causes the tubing to expand in order to accommodate the fluid, and thus increases the pressure of the fluid.

For example, in FIG. 4 a portion of fluid exists between the first roller 108 and the second roller 114 in tubing 126, 127, and 128, and the pressure increase in the fluid may occur in this trapped portion of the fluid. Because the angular speed of the first roller 108 is greater than the angular speed of the second roller 114, the first roller 108 shortens the length of the tubing between the two rollers such that the pressure of the fluid within this length of tubing is increased. The volume of the fluid remains the same but the length of tubing to contain the fluid is decreased, thus forcing the tubing to expand to accommodate the fluid volume, which, in turn, increases the fluid pressure in the length of tubing that expanded to accommodate that fixed fluid volume. In some embodiments, the pressure increase in the fluid may be about 10 psi. This pressure increase occurs throughout the entire second sector 194 (e.g., while the angular speed of the first roller 108 is greater than the angular speed of the second roller 114).

Figure 5:
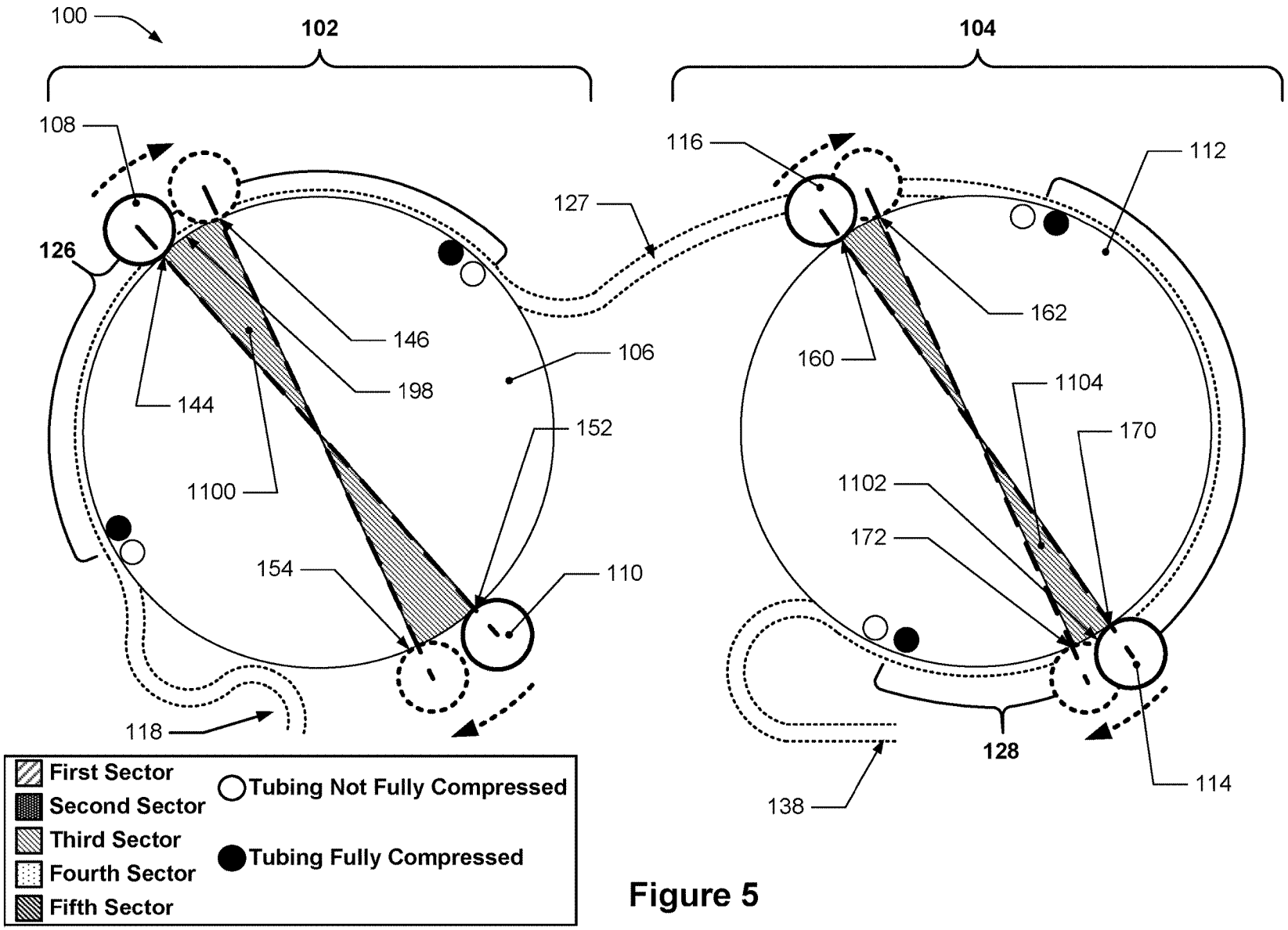
FIG. 5 depicts the peristaltic pump of FIG. 1 with the first rollers orbiting through a third sector of the first disk and the second rollers simultaneously orbiting through a third sector of the second disk.

After the pressure in the tubing is increased to a desired pressure, e.g., equal to the desired output pressure, the first rollers may be slowed down to, and then moved at, the same angular speed of the second rollers in order to move the fluid through the tubing 126, the interconnect tubing 127, and tubing 128 towards the output 138 without further increasing the pressure. The first rollers may also be slowed down before the desired pressure is reached, e.g., such that the desired output pressure is reached near-simultaneously or simultaneously with the first rollers reaching an angular speed that matches that of the second rollers. FIG. 5 depicts the peristaltic pump of FIG. 1 with the first rollers orbiting through a third sector of the first disk and the second rollers simultaneously orbiting through a third sector of the second disk. Referring first to the first stage 102 in FIG. 5, the first roller 108 moves along a section 198 of the periphery of the first disk 106 within a third sector 1100 of the first disk 106, i.e., from position 144 to position 146, while fully compressing the tubing 126. The first roller 108 moves along the section 198 at an angular speed that is greater than the angular speed of the second rollers 114, 116, as they orbit around the second disk 112 but this angular speed is also a decelerating angular speed that decelerates from the angular speed at which the first rollers moved in the second sector 194 (e.g., along the section 192 between positions 142 and 144) to the angular speed at which the second rollers 114, 116 are moving.

The first roller 110 moves in a substantially identical, synchronized manner in a substantially identical sector of the first disk 106, but at a different location, as seen in FIG. 5 by the identically sized and crosshatched sector opposite the third sector 1100 (i.e., movement along a section of the periphery of the first disk between positions 152 and 154 of the first disk); the first roller 110 is not compressing the tubing 126 during this movement.

Referring to the second stage 104 in FIG. 5, the second roller 114 moves along a section 1012 of the periphery of the second disk 1102 within a third sector 1104 of the second disk 112, i.e., from position 170 to position 172 of the second disk 112. The second roller 116 is not compressing the tubing 128 during its simultaneous movement between positions 160 and 162 of the second disk 112.

The deceleration rate of the first rollers 108, 110 from their angular speed in the second sector 194 to the angular speed of the second rollers 114, 116 dictates the length of the section 198 of the periphery of the first disk that the first rollers 108, 110 travel in this third sector 1100. In some embodiments, this deceleration speed is variable. For instance, in some such embodiments, this deceleration speed may be low such that the length of the section 198 that the first roller 108 travels is greater than the length of the section 1102 that the second roller 114 travels, such as depicted in FIG. 5. For instance, in FIG. 5, the second roller 114 is at position 170 of the second disk 112 when the first roller 108 is at position 144 of the first disk 106, and the second roller is at position 172 of the second disk 112 when the first roller 108 is at position 146 of the first disk 106. Because the first roller 108 is moving at a faster angular speed than the second roller 114 moves around the second disk 112 during most of this same period, the first roller 108 travels a greater tangential distance along the periphery of the first disk 106 than the second roller 114 and therefore may cause some additional increased pressure of the fluid trapped between the first roller 108 and the second roller 114 before matching angular velocity with the second rollers.

In some embodiments, this deceleration may occur very quickly, such as near-instantaneously, such that the distance traveled by the first roller is very small compared to the other sections of the periphery of the first disk it travels. In some embodiments, this distance may be negligible or non-existent. Therefore, in some such embodiments, it may be considered that this third sector is, in effect, a single point on the periphery of the first disk.

Figure 6:
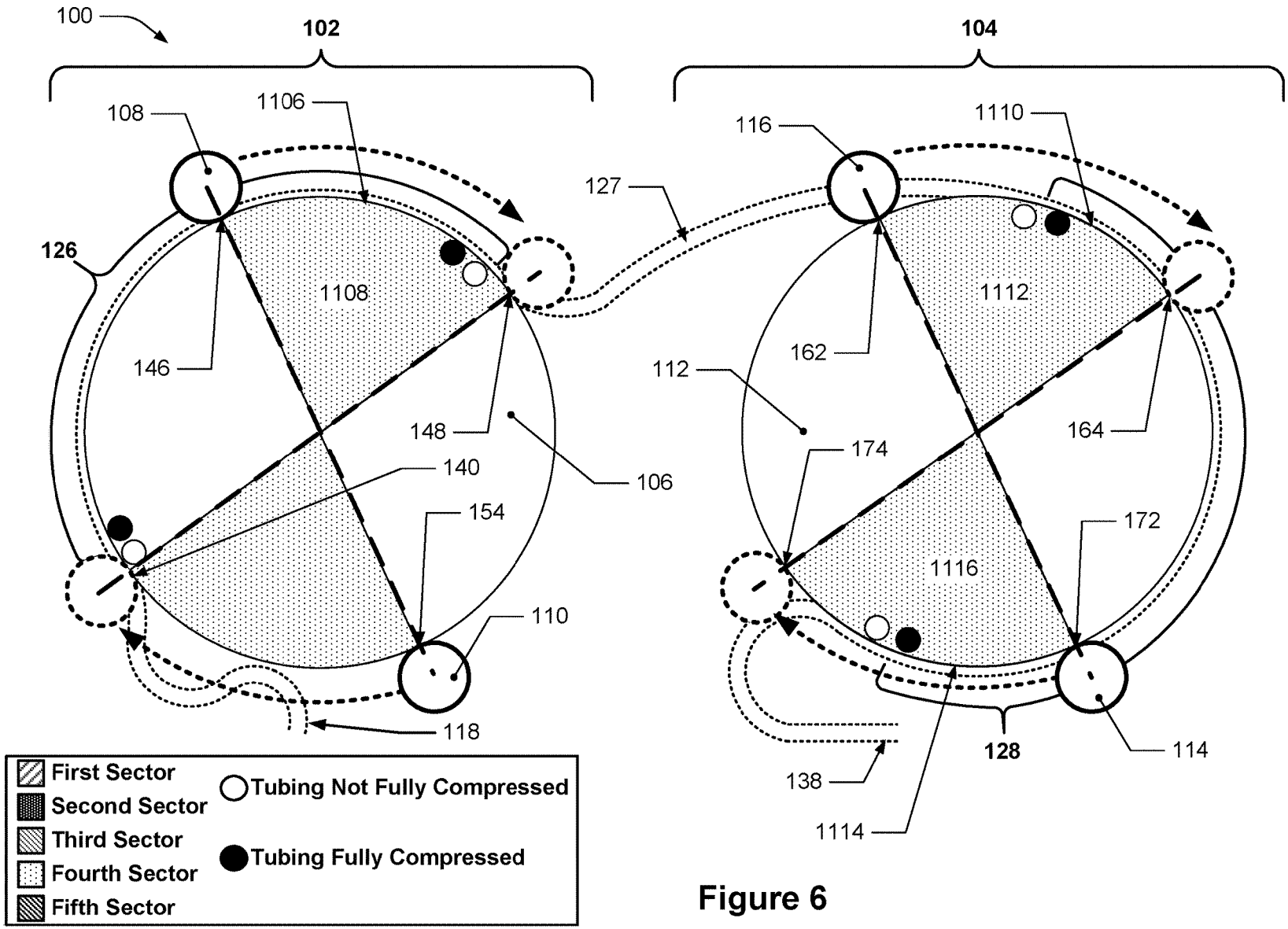
FIG. 6 depicts the peristaltic pump of FIG. 1 with the first rollers orbiting through a fourth sector of the first disk and the second rollers simultaneously orbiting through a fourth sector of the second disk.

Once the angular speed of the first rollers is decelerated to match the angular speed of the second rollers, the first and the second rollers may continue around the first and second disks, respectively, at substantially the same angular speed. FIG. 6 depicts the peristaltic pump of FIG. 1 with the first rollers orbiting through a fourth sector of the first disk and the second rollers simultaneously orbiting through a fourth sector of the second disk. In the first stage 102, the first roller 108 moves along a section 1106 of the periphery of the first disk 106 within a fourth sector 1108 of the first disk 106, i.e., from position 146 to position 148, while fully compressing for a portion of the fourth sector 1108. The first roller 108 moves along the section 1106 at a constant angular speed which substantially matches the angular speed of the second rollers 114, 116, as they orbit around the second disk 112. The first roller 110 moves in a substantially identical, synchronized manner in a substantially identical sector of the first disk 106, but at a different location, as seen in FIG. 6 by the identically sized and shaded sector opposite the fourth sector 1108 (i.e., movement along a section of the periphery of the first disk between positions 154 and 140 of the first disk); first roller 110 is not compressing the tubing 126 during this movement.

As indicated by the shaded and non-shaded circles in the interior of the first disk 106, at position 146 the first roller 108 is fully compressing the tubing 126 and transitions to not fully compressing the tubing 126 at some position in the fourth sector 1108 (i.e., some position along the section disk 1106 of the periphery of the first) such that the first roller 108 is not fully compressing the tubing 126 at position 148, i.e., at the end of the sector. Because of the synchronized movement of the first rollers 108, 110, when the first roller 108 is at position 148, the first roller 110 is at position 140 and both the first rollers 108, 110 are not fully compressing tubing 126 at these positions.

In the second stage 104 in FIG. 6, the second roller 116 moves along a section 1110 of the periphery of the second disk 112 within a fourth sector 1112 of the second disk 112, i.e., from position 162 to position 164 of the second disk 112. In this sector 1112, at position 162 the second roller 116 is not fully compressing the tubing 128 and transitions to fully compressing the tubing 128 at some position in the fourth sector 1112 (i.e., some position along the section 1110 of the periphery of the second disk) such that the second roller 116 is fully compressing the tubing 128 at position 164, i.e., at the end of the sector.

The second roller 114 can also be seen moving along a section 1114 of the periphery of the second disk 112 within an opposing fourth sector 1116 of the second disk 112, i.e., from position 172 to position 174 of the second disk 112. In the opposing fourth sector 1116, at position 172 the second roller 116 is fully compressing the tubing 128 and transitions to not fully compressing the tubing 128 at some position in the opposing fourth sector 1116 (i.e., some position along the section 1114 of the periphery of the second disk) such that the second roller 114 is not fully compressing the tubing 128 at position 174, i.e., at the end of the sector.

As the first rollers and the second rollers move between the positions depicted in FIG. 6, a "handoff" may occur between the first rollers and the second rollers such that a portion of the fluid trapped in tubing 126, interconnect tubing 127, and tubing 128 that is between the first roller 108 and the second roller 114, e.g., between position 146 of the first disk and position 172 of the second disk (which are the positions where the first roller 108 and the second roller 114 are located at the beginning of this phase) is subdivided as another second roller (i.e., the second roller 116) fully compresses the tubing 128 in which the trapped fluid is located. The portion of fluid that is trapped between the two the second rollers 114, 116 (and is at the increased pressure resulting from the movements of the first and the second rollers through their respective second sectors) is thus "handed off" from the first stage 102 to the second stage 104, and the second stage rollers 114, 116 move this handed-off portion of the fluid to the outlet 138 under constant pressure. The other portion of the fluid that is trapped between the first roller 108 and the (recently compressing) second roller, e.g., the second roller 116 in FIG. 6, is also moved at constant pressure towards the outlet. However, when that the first roller 108 stops fully compressing the tubing, e.g., such as at position 148, the portion of the fluid that was trapped between that first roller and a second roller (e.g., the first roller 108 and the second roller 116) will experience a pressure decrease as it equalizes with the lower-pressure fluid that is in tubing 126 and between the two first rollers.

This "handoff" is explained in more detail in FIGS. 7A-7C, which depict a handoff of fluid between the first stage and the second stage of the peristaltic pump. FIGS. 7A, 7B, and 7C show the first and second rollers of the peristaltic pump simultaneously moving through three portions of the sectors depicted in FIG. 6, with each depiction separated by dashed horizontal lines. In FIG. 7A, the first roller 108 is in the process of moving through the fourth sector 1108 and is at a location fully compressing tubing 126. At the same time as the first roller 108 is at this location, the second roller 114 is fully compressing tubing 128 and the second roller 116 is not fully compressing tubing 128. As previously noted with respect to FIG. 6, the first rollers 108, 110 and the second rollers 114, 116 are moving at substantially the same angular speeds during this phase (e.g., the first roller 118 is moving in and through the fourth sector 1108 at substantially the same angular speed as the second roller 116 moves in and through the fourth sector 1112).

In FIG. 7B, the first roller 108 has advanced in and through part of the fourth sector 1108 (e.g., along part of the section 1106 of the periphery of the first disk) in the clockwise direction and is still fully compressing tubing 126. However, the second roller 116 has moved in and through the fourth sector 1112 (e.g., along part of the section 1110 of the periphery of the first disk) such that it is fully compressing tubing 128 while the second roller 114 has moved such that it is not fully compressing tubing 128. In some embodiments, one second roller may transition to fully compressing the tubing wrapped around a portion of the periphery of the second disk while at substantially the same time the other second roller transitions to not fully compressing the tubing. While simultaneous transitions between compression/non-compression and non-compression/compression may be ideal in a system with two second rollers, in practice, this compression by one second roller and simultaneous release by the other second roller may not occur at precisely the same moment in time and therefore, in some embodiments, this compression by one second roller and simultaneous release of the other second roller may occur at times within +/−15% of each other. In some such embodiments, the second disk 112 may be configured such that the lead second roller (e.g., the second roller moving to not fully compress the tubing) may not stop fully compressing the tubing until the other second roller is fully compressing the tubing. Accordingly, referring back to FIG. 7B, the second roller 116 may begin fully compressing tubing 128 at substantially the same time as the second roller 114 stops fully compressing tubing 128. As can also be seen in FIG. 7B, during this transition of compression by the second rollers 114, 116, the first roller 108 is still fully compressing tubing 126 thus preventing any back flow through the pump, including through and out the inlet 118.

In FIG. 7C, the first roller 108 has moved farther in and through part of the fourth sector 1108 (e.g., along part of the section 1106 of the periphery of the first disk) in the clockwise direction and has moved from fully compressing tubing 126 to not fully compressing tubing 126. During this transition of the first roller 108, at least one second roller, e.g., the second roller 116, is fully compressing tubing 128. In such embodiments, the one first roller 108 has moved along the section 1106 of the periphery of the first disk such that it was fully compressing the tubing 126 at the beginning of this section and was not fully compressing the tubing 126 at the end of this section, and simultaneously the second roller 116 moved along the section 1110 of the periphery of the second disk such that it was fully compressing tubing 128 in this section before the first roller 108 was not fully compressing tubing 126.

Once the second roller 116 is fully compressing tubing 128 and the second roller 114 is not fully compressing tubing 128, as seen in FIGS. 6, 7B, and 7C, the second roller 116 has taken on the task of moving the fluid in tubing 128, while second roller 114 has moved to a position where there is no compression, so that the fluid being moved by the second roller 116 can pass through to the output tubing 138. As such, the second stage 104 simply moves the fluid by alternately using the second rollers 114, 116 to advance the fluid in tubing 128. As mentioned above, in some embodiments, the second disk 112 is configured such that full compression of tubing 128 is caused by a second roller moving along section 1110 (e.g., between positions 162 and 164) before another second roller simultaneously moving between positions 172 and 174 is not fully compressing tubing 128.

Figure 8:
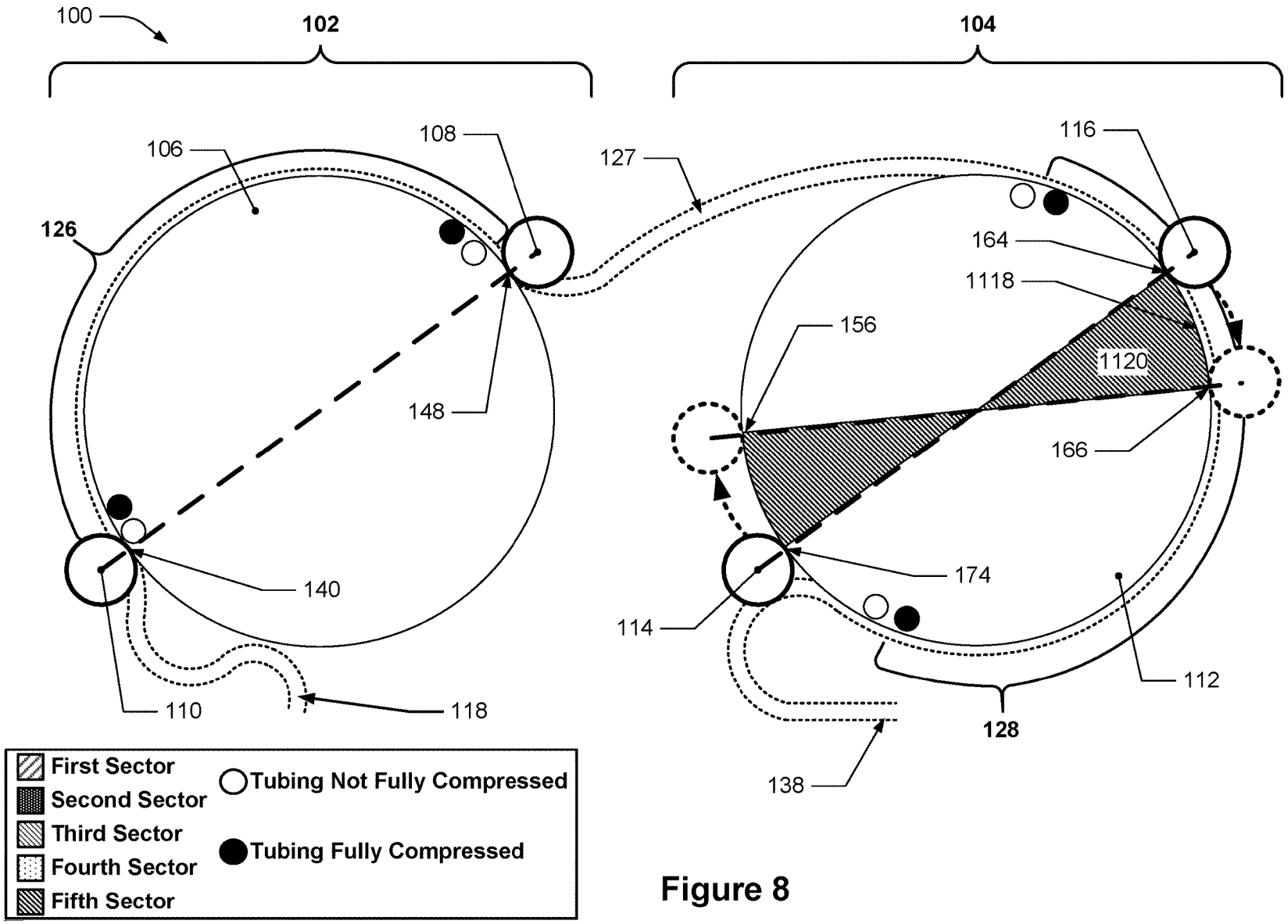
FIG. 8 depicts the peristaltic pump of FIG. 1 with the first rollers stopped and the second rollers simultaneously orbiting through a fifth sector of the second disk.

After the handoff occurs between the first stage 102 and the second stage 104, both the first rollers 108, 110 may not be fully compressing the tubing 126 and may slow or stop their movement. FIG. 8 depicts the peristaltic pump of FIG. 1 with the first rollers stopped and the second rollers simultaneously orbiting through a fifth sector of the second disk. As can be seen in the first stage 102 of FIG. 8, the first roller 108 is at position 148 and the first roller 110 is at position 140, and both are not fully compressing tubing 126. In the second stage 104, however, while the first rollers of the first stage 102 are stationary, the second rollers 114, 116 continue to rotate at their constant angular speed. Here, the second roller 116 moves along a section 1118 of the periphery of the second disk 112 within a fifth sector 1120 of the second disk 112, i.e., from position 164 to position 166 of the second disk 112 (i.e., sector 1120) while fully compressing tubing 128. This movement of the second roller 116 not only moves fluid in tubing 128 to the tubing output 138, but also may draw in fluid through the inlet tubing 118. The second roller 114 is not compressing the tubing 128 during it simultaneous movement between positions 174 and 156 of the second disk 112.

In some embodiments, the first rollers may be not stopped, but rather may be moving at an angular speed less than that of the second rollers, thereby moving through corresponding fifth sectors of the first disk. In such embodiments, the first rollers may still be not fully compressing the tubing 126. The non-movement or very slow angular movement of the first rollers in this interval allows the second rollers to "catch up" to the positions that the second rollers were in when the pumping cycle started, as shown in FIG. 3. Once the first rollers and the second rollers are back in the positions they were in in FIG. 3, the next pumping cycle can begin and the process outlined above can proceed continuously in order to pump the fluid at a constant pressure with little or no pulsation in the fluid output stream.

Based on the above-described movement of the first rollers 108, 110 and the second rollers 114, 116, the first rollers 108, 110 rotate around some parts of the first disk 106 synchronously with the second rollers 114, 116. Consequently, the rotational phase of the first rollers 108, 110 and the second rollers 114, 116 is constant in some instances and not constant in other instances.

It should also be noted that the first roller 108 continues to draw fluid through the intake tubing 118, as it rotates clockwise around the periphery of the first disk 106, i.e., from soon after position 140 through a position before position 148 when it stops fully compressing tubing 126. As noted above, once the first rollers 108, 110 are both not compressing tubing 126, the second roller that is fully compressing tubing 128 may continue to draw fluid into the intake tubing 118.

Figure 9:
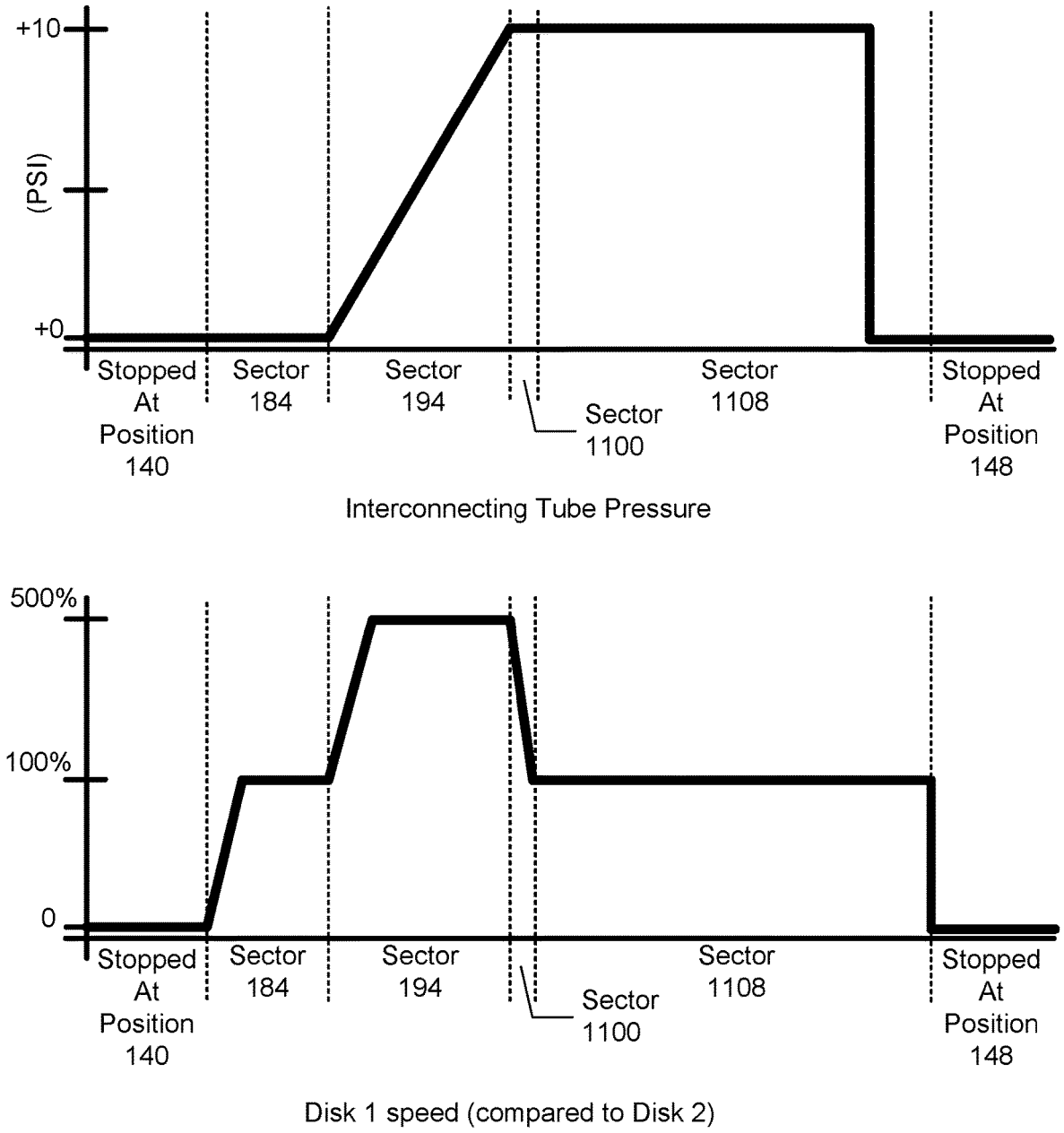
FIG. 9 depicts an example pressure chart of the interconnecting tubing between the first and second stages of the peristaltic pump and an example speed chart of the first rollers.

As noted above, the peristaltic pump 100 of FIGS. 3-8 is configured to increase the pressure of a fluid in the tubing and pump that increased-pressure fluid through the tubing. The relationship between the movements of the first and second rollers around the first disk and second disk as described in FIGS. 3-8 may be further illustrated by example pressure and speed graphs. FIG. 9 depicts an example pressure chart of the interconnecting tubing between the first and second stages of the peristaltic pump and an example speed chart of the first rollers. More specifically, as explained herein, FIG. 9 depicts the angular speed of the first rollers and pressure increase (in psi units) of the fluid in the interconnecting tubing 127 as a first roller travels from about position 140 to about position 148. The top portion of FIG. 9 is a pressure chart depicting the pressure increase in the interconnecting tubing, e.g., 127 of FIG. 3, with pressure increase in the vertical axis and position of a first roller in the horizontal axis; the bottom of FIG. 9 is an example angular speed chart of the first roller as a percentage of the angular speed of the second roller, with speed percentage in the vertical axis and position of the first roller in the horizontal axis. The two charts also show the respective sector and/or position that the first roller is traversing or where it is located, and the two charts are temporally aligned with each other. The zero points of the vertical axes have been offset in order to see when each measurement line is at zero more clearly.

Beginning at the left of each chart, the first roller 108 begins at position 140, like depicted in FIG. 3 when the first roller 108 is at the beginning of the first sector 184. The first roller 108 may have been located at this position 140 for a period of time, similar to that described in FIG. 8. When the first roller is stopped or moving slower than the constant angular speed of the second rollers, this may be considered a "park" phase of the first roller. In the next phase of the charts of FIG. 9, the first roller 108 is moving through the first sector 184, as described in FIG. 3. As can be seen, the speed of the first rollers around the first disk 108 increases from zero to 100% of the angular speed of the second rollers 114, 116 around the second disk. This phase may be considered a "pinching phase" since the tubing will be fully compressed or pinched by a first roller during this phase, thereby locking in a segment of fluid between the first roller and a second roller.

As noted above and seen in FIG. 9, the pressure increase in the interconnect tubing 127 may be zero when the first roller is at position 140, i.e., "parked", and while the first roller 108 is "pinching". The pressure increase of the interconnecting tubing 127 occurs once the first roller 108 moves at an angular speed greater than that of the second rollers, e.g., through the second sector 194 like described above with respect to FIG. 4. This may be considered a "pressurizing" phase. Therefore, as seen in FIG. 9, the pressure in the interconnecting tubing 127 increases as the speed of the first roller 108 increases to an angular speed greater than the second rollers. For instance, the first roller 108 in FIG. 9 increases and then maintains its angular speed at 500% of the angular speed of the second rollers thereby increasing the pressure by, for instance, 10 psi.

Once the first roller 108 has moved to cause the pressure to increase to the desired level, the first roller then may decrease its angular speed, as described above for the third sector 1100 in FIG. 5. Once the first roller 108 has reduced its speed to the angular speed at which the second rollers are moving, the pressure is no longer increased, but maintained, as seen in the charts of FIG. 9. During this phase, i.e., a "tracking" phase, the first roller 108 is moving through the fourth sector 1108 at the same angular speed as the second rollers, thereby maintaining the pressure in the interconnecting tubing 127 as described above in FIG. 6. However, during this phase the first roller 108 stops fully compressing the tubing 126 as described in FIGS. 6 and 7A-7C, e.g., the "handoff" between the first stage 102 and the second stage 104. Accordingly, once the first roller 108 stops fully compressing the tubing 126, the pressure increase in the interconnecting tubing 127 drops to a lower pressure, such as zero like depicted in FIG. 9, and equalizes pressure with tubing 126.

After the first roller 108 stops fully compressing the tubing 126 in the fourth sector 1108, the first roller 108 stops at position 148, like previously described in FIG. 8. At this position, the pressure of interconnecting tubing is at zero and the angular speed of the first roller 108 is at zero. Although FIG. 9 was described with respect to one first roller, in the embodiments in which two first rollers are used, it should be understood that the other first roller 110 correspondingly rotates as previously described in FIGS. 3-8 such that the pressures and speeds of FIG. 9 may be repeated.

Accordingly, first stage 102 functions to increase the pressure of the fluid that is being drawn from the intake tubing 118 by causing the first rollers 108, 110 to move faster than the second rollers 114, 116 move around the second disk 112 by increasing the angular speed of the first rollers 108, 110 during certain portions of the pumping cycle. As such, the two stage peristaltic pump is capable of pumping fluids with minimal pressure variation at the outlet, which results in little or no pulsing of the fluid at the output tubing 138. Additionally, referring back to FIGS. 6 and 7A-7C, when the second roller 114 moves from position 172, where there is full compression, to position 174, where there is no compression, a volume is created in the tubing. The second roller 116 moves from position 162, where there is no full compression, to position 164, where there is full compression. As such, the second roller 116 compresses the tubing, which displaces the same volume as the volume that is created when the second roller 114 moves from position 172 to position 174. In this manner, a constant pressure is maintained.

After the above-described movements of the first and second rollers of the peristaltic, such movements may be repeated in a similar and/or identical matter so that the pump will continue to pump the fluid at a continuous output pressure. For example, once the second rollers have traveled along the periphery of the second disk as described with respect to FIG. 8, the first rollers and the second rollers may be located in the same positions as they started in FIG. 3, except that the first rollers and the second rollers have shifted 180 degrees from their respective positions depicted in FIG. 3. For instance, the movement of the first rollers 108, 110 around the first disk 106 and the movement of the second rollers 114, 116, may be the same as previously described in FIGS. 3-8, except that the movements of the rollers are swapped such that, for example, the first roller 110 moves as described with respect to the first roller 108 in FIGS. 3-8 and likewise the second roller 116 moves as described with respect to the second roller 114.

Figure 10:
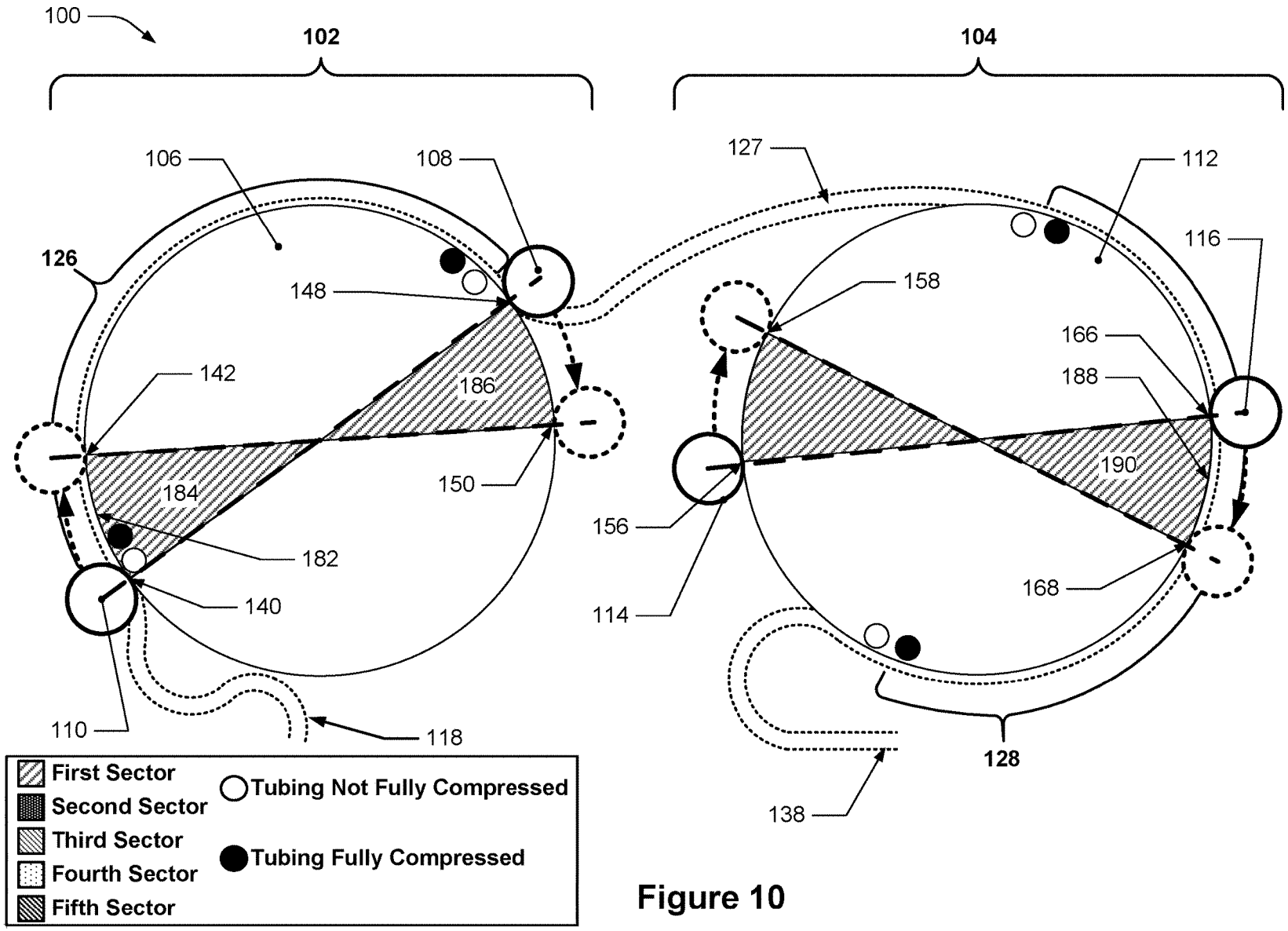
FIG. 10 depicts the peristaltic pump of FIG. 1 with the first rollers orbiting through the first sector of FIG. 3 and the second rollers simultaneously orbiting through the first sector of FIG. 3.

For example, FIG. 10 depicts the peristaltic pump of FIG. 1 with the first rollers orbiting through the first sector of FIG. 3 and the second rollers simultaneously orbiting through the first sector of FIG. 3. As can be seen, the first roller 108 is at position 148 but in FIG. 3 it was located at position 140; similarly, the second roller 116 is at position 166 but in FIG. 3 it was at position 156.

Once the first and second rollers move around the periphery of the first disk and second disk, respectively, the movements of the rollers may again repeat as described with respect to FIGS. 3-8. For example, after the first roller 108 has moved as previously described in FIGS. 3-9, the other first roller 110 may move in the same sectors and at the same speeds as described for the first roller 108. For instance, the angular speed of the other first roller 110 may be increased from zero to substantially equal to the angular speed of the second rollers, e.g., from position 140 to 142 like described in FIG. 3 with respect to the first roller 108. Additionally, the first roller 110 may move along the section 192 at the same increased angular speed as the first roller 108 in order to increase the pressure of the fluid in the tubing 126 and interconnecting tubing 127 that is trapped between the first roller 110 and the second roller 116.

In some embodiments, the subsequent movements of the first rollers may not be identical to those previously described. For instance, after the first roller 108 has moved as previously described in FIGS. 3-9, the other first roller 110 may increase the pressure of the fluid in the tubing 126 and interconnecting tubing 127 that is trapped between the first roller 110 and the second roller 116 by moving at a different angular speed and/or angular distance than that of the first roller 108 in FIG. 4. For example, the first roller 110 may move along the same section 192 of the periphery of the first disk (e.g., in and through all of the second sector 194) but at a faster or greater angular speed than the first roller 108 moved through the same sector; the first roller 110 may move along a different length of the periphery of the first disk, such as a section that is greater or less than the section 192 of the periphery of the first disk, i.e., a different sized sector than the second sector 194, but at the same speed as the first roller 108 moved in and through the second sector 194; or the first roller 110 may move at both a different angular speed and along a different length of section of the periphery of the first disk than the first roller 108 moved as described in FIG. 3. Such movements of the first roller 110 may cause an increase in pressure of the fluid trapped between the first roller 110 and the second roller 116 that is the same, greater, or less than the pressure increase previously described in FIG. 3. This movement may be seen during an initial startup or when the desired output pressure is changed, e.g., by a user.

As mentioned above, the peristaltic pump disclosed herein may be configured to identify and account for air in the tubing. Air may be drawn into the tubing when the peristaltic pump is running constantly and the uptake probe of the autoloader or liquid handling device is periodically removed from the sample fluid. For example, referring back to FIG. 1, the uptake probe 122 may move vertically downwards into a well of the well plate 124, the fluid in the well may be drawn into the intake tubing 118 and after drawing such fluid, the uptake probe 122 may be moved vertically upwards out of the well, horizontally towards another well of the well plate 124, and then vertically downwards into that other well. If the pump is running constantly during this process, air may be drawn into the tubing while the uptake probe 122 is moving and not in a fluid of the well plate 124.

The air that is drawn into the tubing may be identified or estimated in various manners. For instance, the estimate of air in the tubing 126 may be based on, at least in part, each incremental movement, i.e., a "count", of the first disk and/or the second disk of the peristaltic pump that it takes the peristaltic pump to move fluid from the uptake probe 122 to the tubing 126 and the number of counts the uptake probe is in air. For instance, an estimate may be made of a particular volume of air that is drawn through the uptake probe during the time (i.e., for the particular counts) that the probe is in the air, and another estimate may be made as to the time (i.e., the particular counts) it takes for a volume of fluid (e.g., air or liquid) to travel from the uptake probe 122 through tubing 118 and to the tubing 126. For instance, the uptake probe may be in the air for 30 counts, fluid may move from the uptake probe to the tubing 126 in 350 counts, and accordingly, the volume of air may reach the tubing 126 after about 350 counts and may continue to enter tubing 126 until about 380 counts. Such calculations may be an estimate or identification of intervals with a heightened probability of having air bubbles in the tubing, and may be used to estimate the amount of air that is present. In another example, a sensor may be used that may detect and/or measure air in the tubing.

The peristaltic pump disclosed herein may be configured to account for the presence of air bubbles in the tubing, such as in the tubing between one first roller and one second roller. This may entail estimating, detecting, and/or identifying air bubbles in the tubing and then causing the first roller to move such that it decreases the volume of the tubing that contains the trapped liquid and air in order to cause that volume of both air and liquid to have the desired pressure. For example, if only liquid is trapped in the tubing between a first roller and a second roller, then the pressure on the fluid is exerted entirely by the walls of the tubing that are stretched (as caused by the first roller's above-described movement). However, if both liquid and air are trapped in the tubing between a first roller and a second roller, then the bubble will compress somewhat, causing the tubing to expand less, thereby exerting less pressure on the liquid. To account for that, the tubing length must be further decreased so that the tubing is stretched to the same amount as without the bubble, which exerts the same pressure on the liquid in the tubing.

Although two first rollers have been discussed herein, it is to be understood that the peristaltic pump disclosed herein may be configured to function with only one first roller. In some such embodiments, the first roller may move from position 140 of the first disk 106 clockwise through position 148 in the same manner as described herein above, but may move from position 148 clockwise to position 140 in a different manner. For instance, the first roller may be moved at a high angular speed clockwise from position 148 to position 140 while not fully compressing the tubing 126 such that it may arrive at position 140 and move from position 140 when the other first roller 110 would have moved from position 140; this movement may occur during the aforementioned "park" phase and therefore replace that phase. In essence, the single first roller is configured to operate for both the first rollers 108 and 110 between positions 140 and 148.

Additionally, even though the description of the movement of the first rollers and second rollers began when the rollers were at their respective positions in FIGS. 1 and 3, the movement of the first rollers and second rollers may begin at any location along the first disk and second disk, respectively. Furthermore, as mentioned above, once movement has started, the peristaltic pump may be configured to move the first rollers in such a manner that various pressure increases are caused to the fluid in the tubing, after which a steady, constant movement and pressurization occurs.

In addition to the above description, the peristaltic pump disclosed herein may also be configured to pump fluid in the reverse direction through the pump. For instance, fluid may be drawn through the outlet 138, then through tubing 128, 127, and 126, respectively, and out the inlet 118. This reverse pumping may be performed by rotating both the first rollers 108, 110 and the second rollers 114, 116 in the reverse direction, e.g., counterclockwise as depicted in the above-described Figures. In some embodiments, it may not be necessary or desired to increase the pressure of fluid pumped in this reverse direction and accordingly, the angular speeds of the first rollers 108, 110 and the second rollers 114, 116 may be substantially the same during this reverse pumping. The reverse pumping may be useful to cleaning or clearing out the pump by drawing in a rinse fluid or other cleaning fluid through the pump.

For example, the peristaltic pump 100 of FIG. 1 may pump fluid through the outlet 138, then through tubing 128, 127, and 126, respectively, and out the inlet 118 by orbiting second roller 114 counterclockwise at the second angular speed through the fourth sector 1116 (depicted in FIG. 6), i.e., from position 174 to position 172, so that it transitions from not fully compressing the tubing to fully compressing the tubing 128. The second roller then continues rotating counterclockwise along the periphery of the second disk while fully compressing tubing 128 through the third 1104, second 197, first 190, and fifth 1120 sectors of the second disk, respectively, and through the fourth 1112 sector the second roller 114 transitions from fully compressing the tubing to not fully compressing the tubing 128.

As the second roller 114 orbits the second disk, a first roller, such as first roller 108 also orbits the first disk 106 counterclockwise at substantially the same angular speed as the second roller 114 so that the pressure of the fluid in the tubing 126, 127 and 128 between these two rollers is not increased. The first roller 108 may thus simultaneously move through the fourth 1108, third 1100, second 194, and first 184 sectors of the first disk 106, respectively, while fully compressing the tubing 126, but transitioning to not fully compressing the tubing 126 towards the end of the first sector 184. This movement by the first rollers 108, 110 and the second rollers 114, 116 draws fluid into the pump through the outlet 138 and through tubing 128, 127, 126, and the outlet tubing 118, respectively.

In another example of the reverse pumping, the second rollers 114, 116 may orbit the second disk 112 counterclockwise as described directly above, but the first rollers 108, 110 may be positioned in the "park" location, i.e., positions 148 and 140, respectively, of the first disk 106 such that the tubing 126 around part of the periphery of the first disk 106 is not compressed. The first rollers 108, 110 therefore are not preventing fluid from flowing through tubing 126. Accordingly, the counterclockwise movement of the second roller 114, 116 pumps fluid through the peristaltic pump from the outlet 138, through tubing 128, 127, 126, and the outlet tubing 118, respectively.

Figure 11:
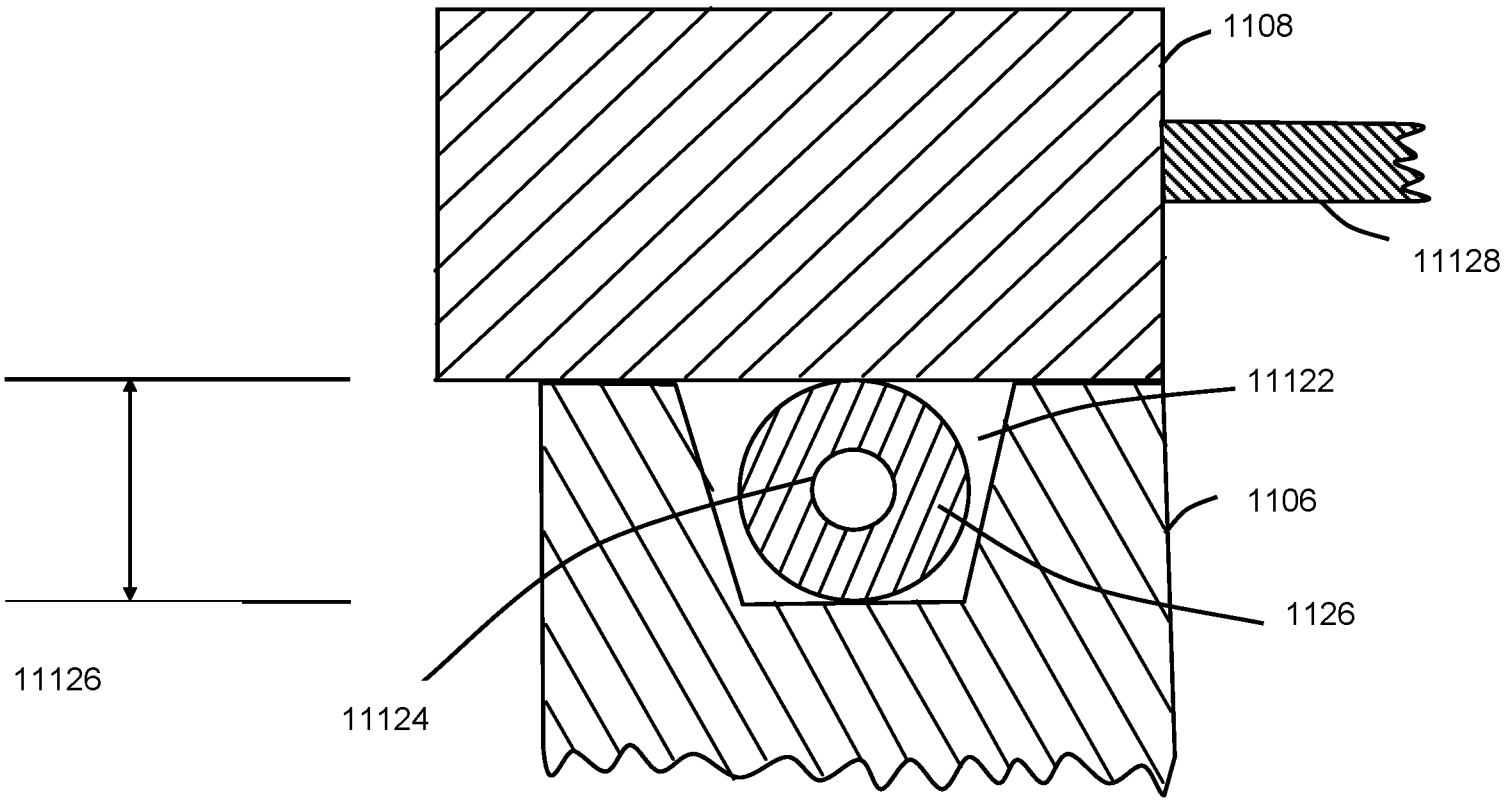
FIG. 11 is a cross-sectional view of a disk and a roller depicting a trough, or recess, in the periphery of a disk.

As noted above, the periphery of each disk may have a recess (i.e., trough) that is configured to receive the tubing and configured to cause the tubing to be exposed to a roller to various degrees in order to fully compress, partially compress, or not compress, the tubing. FIG. 11 is a cross-sectional view of a disk and a roller depicting a trough, or recess, in the periphery of the disk. Although FIGS. 11 through 14 are shown with the disk labeled and referred to as first disk 1106 (which may be the same as first disk 106), such embodiments are equally applicable to the second disk. As shown in FIG. 11, the outer periphery of the first disk 1106 has a trough 11122 (i.e., recess), that has a first depth 11126. Flexible tubing 1126 in trough 1122 is not compressed, since the first roller 1108 rides along the outer, or peripheral portions of the first disk 1106 and does not compress the flexible tubing 1126. The flexible tubing has an opening 11124 in this state that is not compressed and is fully open, so that fluid can easily flow through the flexible tubing 1126 as a result of the first depth 11126 of the trough 11122 at this location on the periphery of the first disk 1106. The tubing 1126 has a nominal outer diameter in an undeformed state and trough 11122 is configured such that the first depth 11126 substantially matches this nominal outer diameter so that the first roller 1108 does not compress the tubing 1126. In some embodiments, there may be a gap, notch, and/or groove in the periphery of each of the disks to enable the tubing to exit and/or enter the trough of a respective disk without a roller that orbits that disk contacting the tubing at that location. The first roller 1108 rolls along the outer peripheral surface of the first disk 1106 at the edges of the trough 11122 and rotates on the roller shaft 11128.

Figure 12:
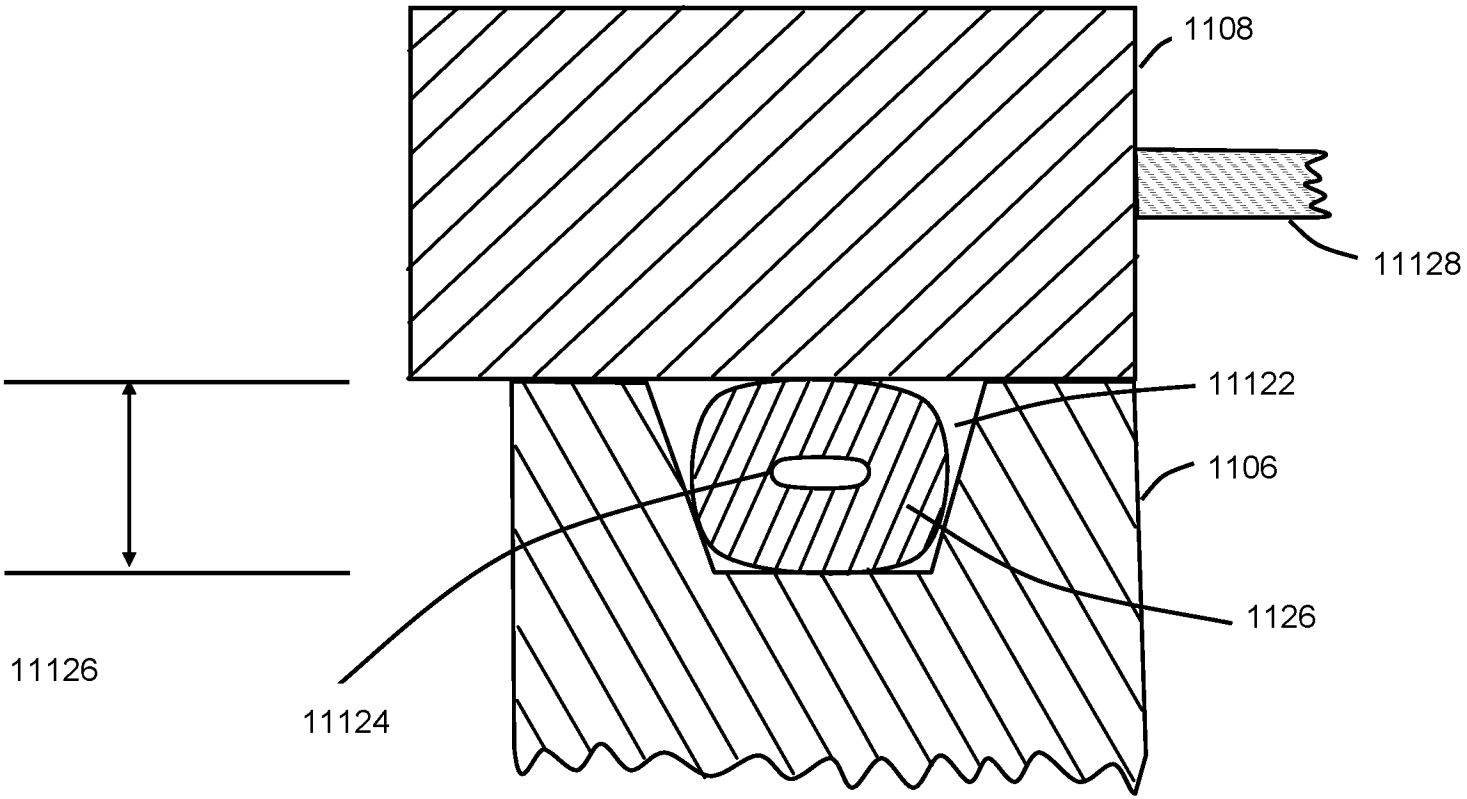
FIG. 12 is a cross-sectional view of the first disk, the first roller, and flexible tubing at a different location along the periphery of the first disk of FIG. 11.

FIG. 12 is a cross-sectional view of the first disk, the first roller, and flexible tubing at a different location along the periphery of the first disk of FIG. 11. As illustrated in FIG. 12, the trough 11122 is not as deep as the trough 11122 in FIG. 11, i.e., the first depth 11126 in FIG. 12 is less than the first depth 11126 depicted in FIG. 11. As such, the surface of the first roller 1108 contacts the flexible tubing 1126 and causes the flexible tubing 1126 to be partially compressed in the trough 11122. Again, the first roller 1108 is rolling along the outer peripheral surface of the first disk 1106 and rotating about roller shaft 11128, as illustrated in FIG. 12. Since the flexible tubing 1126 is compressed, the opening 11124 is also partially compressed so that not as much fluid can flow through the opening 11124 in the flexible tubing 1126.

Figure 13:
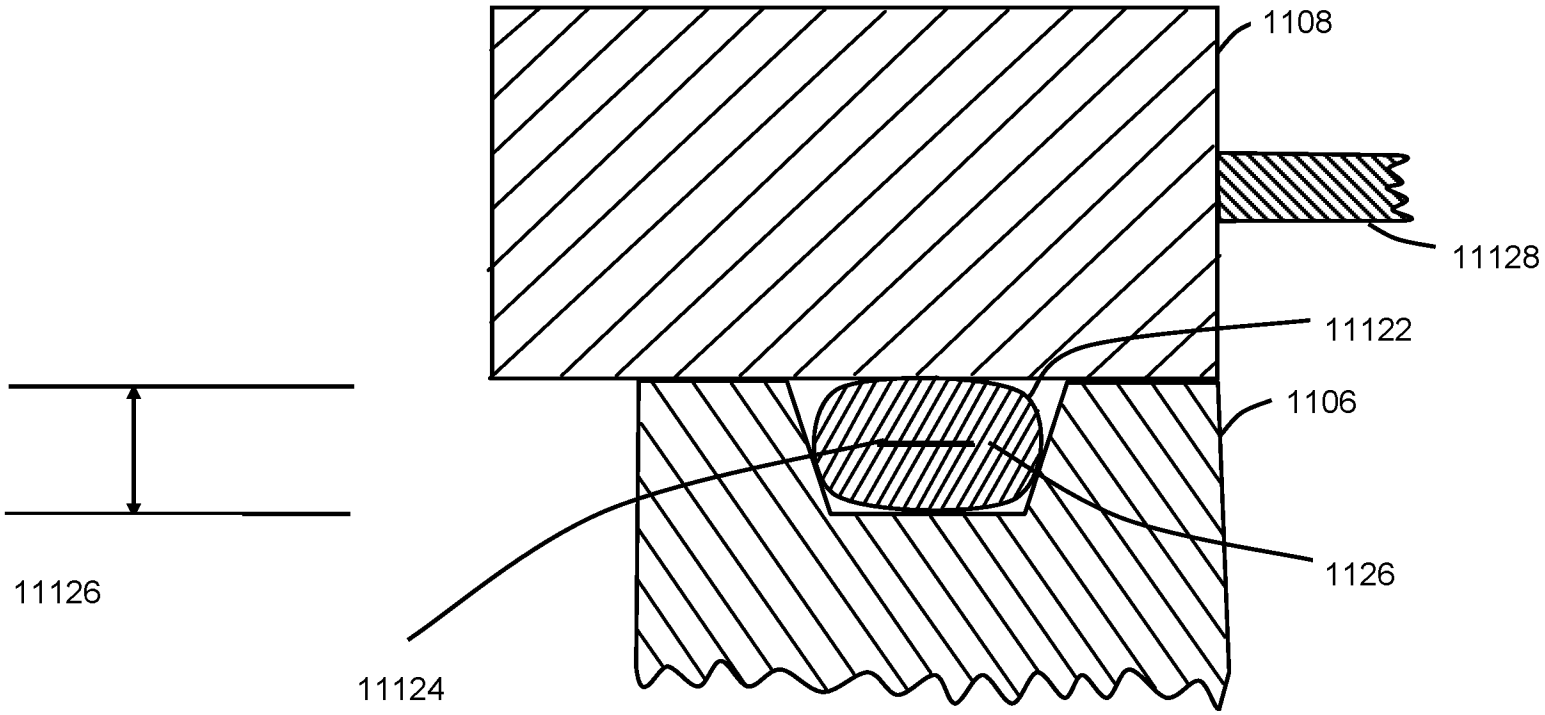
FIG. 13 is a cross-sectional view of the first disk, the first roller, and the flexible tubing at another location along the periphery of the first disk of FIG. 11.

FIG. 13 is a cross-sectional view of the first disk, the first roller, and the flexible tubing at another location along the periphery of the first disk of FIG. 11. As illustrated in FIG. 13, the trough 11122 is not as deep as the trough 11122 in FIG. 12. In other words, the trough, or first recess, 11122 has a first depth 11126 that is less than the nominal outer diameter of the tubing, thereby causing the tubing 1126 to extend past the periphery of the first disk 1106 such that the first roller 1108 fully compresses the tubing 1126 in the trough 11122 when the surface of the first roller 1108 contacts the flexible tubing 1126. Generally speaking, the first depth 11126 would be less than or equal to twice the wall thickness of the tubing in order to cause such full compression. Tubing that is "fully compressed," as the term is used herein, is tubing that has been squashed or compressed to the point where no fluid is able to pass the point of compression within the tubing at the operating pressures utilized. Opening 11124 is fully closed in FIG. 13. Again, the first roller 1108 is rolling along the outer peripheral surface of the first disk 1106 around roller shaft 11128, as illustrated in FIG. 13. Since the flexible tubing 1126 is fully compressed, the opening 11124 is completely closed off so that no fluid can flow through the opening 11124 in the flexible tubing 1126.

Figure 14:
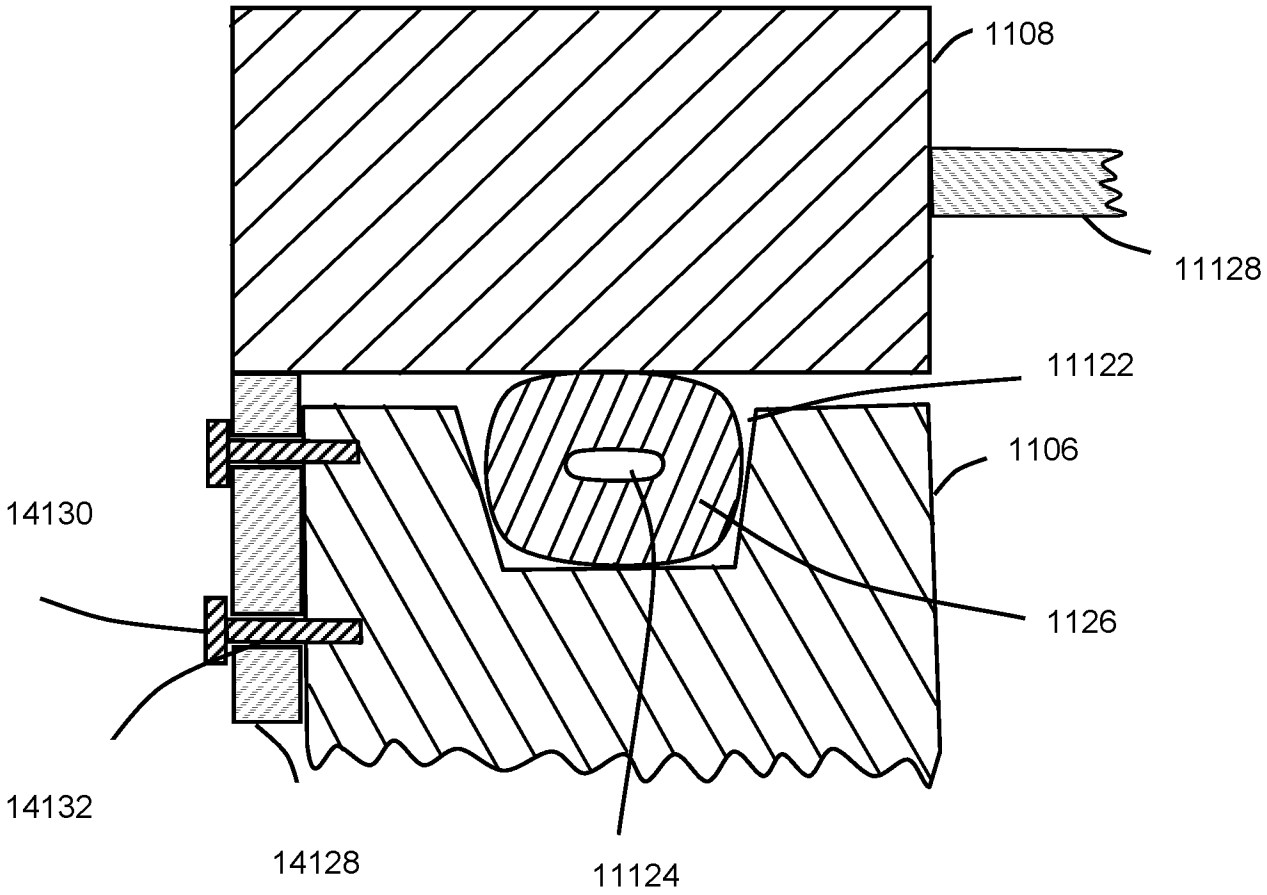
FIG. 14 illustrates another embodiment of the manner in which the first roller can be used to compress the flexible tubing using an adjustment plate.

FIG. 14 illustrates another embodiment of the manner in which the first roller can be used to compress the flexible tubing using an adjustment plate. As illustrated in FIG. 14, adjustment plate 14128 is anchored to first disk 1106 by adjustment screws 14130; the adjustment plate 14128 may be considered to be part of the first disk 1106. The adjustment screws 14130 extend through the openings 14132 in the adjustment plate 14128 and are screwed into the first disk 1106. Other types of connectors could also be used that are well known in the art. The first roller 1108, which rotates on roller shaft 11128, rests on the outer surface of the adjustment plate 14128. In this manner, if the trough 11122 is not the desired depth, the adjustment plate 14128 can be used to provide adjustment as to the location and amount which the first roller 1108 compresses the flexible tubing 1126. For instance, the adjustment plate may extend past a portion of the periphery of the first disk 1106, thereby effectively extending the periphery of the first disk 1106, and thereby cause the first roller 1108 to be in contact with the first adjustment plate 14128 and offset from the periphery of the first disk 1106 such that the first roller 1108 partially compresses the tubing 1126. In some embodiments, this adjustment plate may form part of the trough 11122, i.e., recess. Also, for example, at the location illustrated in FIG. 14, the opening 11124 is partially open. Without the adjustment plate 14128, the opening 11124 would be fully closed if the first roller 1108 was sitting on the peripheral edge of the first disk 1106. In this manner, the pressure of the fluid can be adjusted, as well as the location where fluid can flow along the disk. By adjusting the radial location of the adjustment plate, the location where the roller fully compresses the flexible tubing can be adjusted, which allows both the pressure generated in the compression phase and the alignment of the second rollers' 114, 116 transition to be adjusted.

Figure 15:
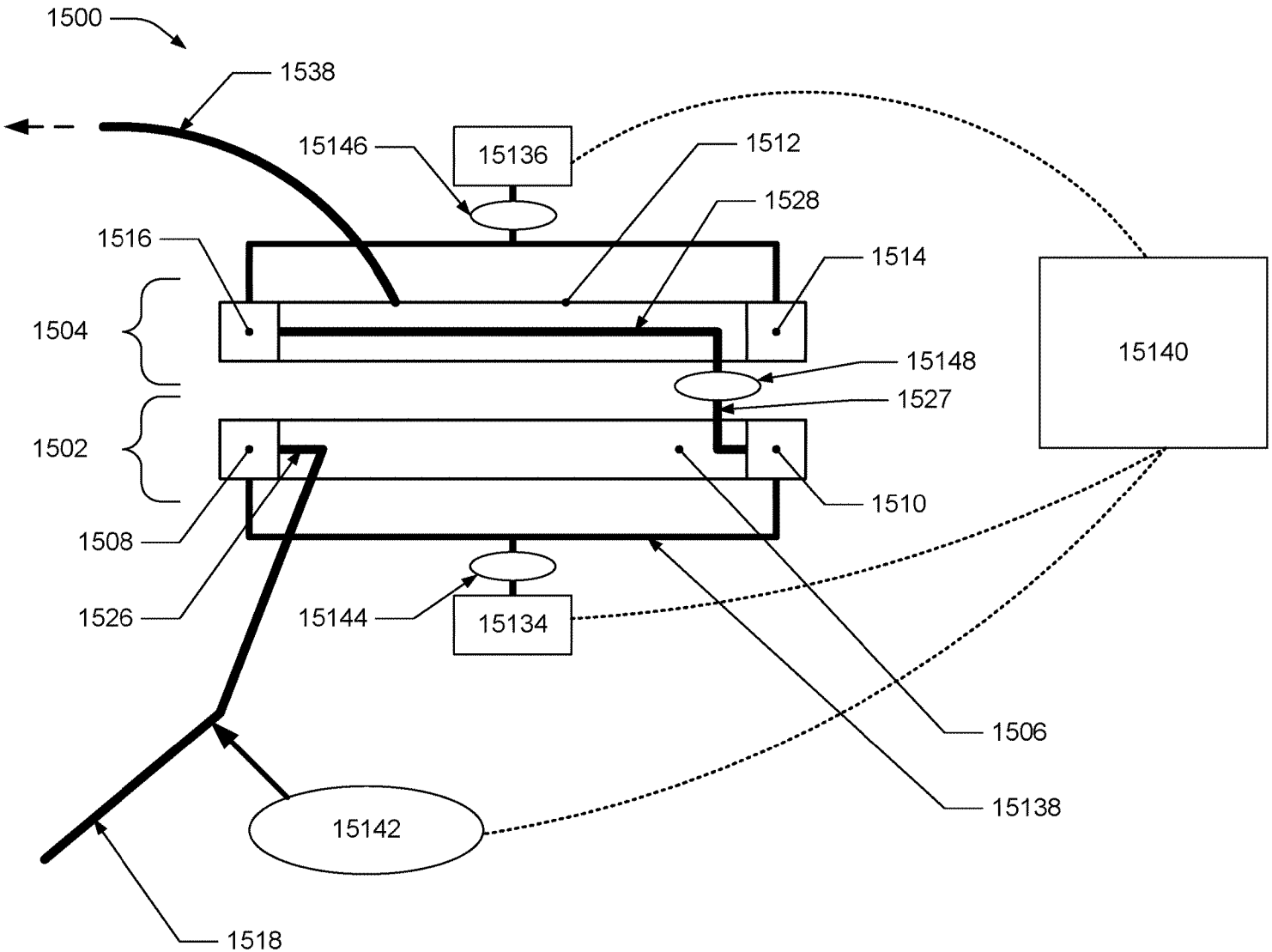
FIG. 15 depicts an example system of a peristaltic pump.

In some embodiments, a system may be provided that includes aspects of the peristaltic pump disclosed herein above. FIG. 15 depicts an example system of a peristaltic pump. Here, system 1500 includes a first stage 1502 and a second stage 1504, both of which are the same as the first stage 102 and second stage 104 discussed herein above with respect to FIGS. 1-14. The first stage 1502 includes the first disk 1506, the first rollers 1508, 1510, and the second stage 1504 includes the second disk 1512 and the second rollers 1514, 1516, which are all configured as previously described hereinabove.

The system 1500 may also include a first motor 15134 that is configured to move, i.e., orbit, the first rollers 1508, 1510 around the first disk 1506 at multiple angular speeds, including a speed of zero, and a second motor 14136 that is configured to move the second rollers 1514, 1516 around the second disk at a constant angular speed. The system 1500 may also include a first roller support arm 15138 (which may be considered part of the first stage 1502) to which the first rollers 1508, 1510 are connected such that the first motor 15134 causes the support arm 15138 to rotate which in turn causes the first rollers 1508, 1510 to move around the first disk 1506. Second stage 1506 may be similarly configured (e.g., the support arm is shown but not labeled).

The system may also include a controller 15140 configured to control the system. Controller 15140 may include one or more processors and a memory that may store instructions for controlling the one or more processors to execute various instructions, which may be collectively referred to herein as "control logic," for causing the first and second stages to pump fluid through the tubing, such as all of the operations described herein above, like in FIGS. 3-9. Control logic may also be provided by application-specific integrated circuits or other electronic devices that provide similar functionality. For instance, the controller may store control logic for causing the first rollers 1508, 1510 to orbit around the periphery of the first disk 1506 at a first angular speed and a second angular speed that is less than the first angular speed, causing the plurality of second rollers 1514, 1516 to orbit around the periphery of the second disk 1512 at the second angular speed, increasing the pressure of a portion of the fluid in the tubing between one first roller, e.g., the first roller 1508, and one second roller, e.g., 1514, by causing the first rollers 1508, 1510 to orbit at the first angular speed so that the one first roller, e.g., the first roller 1508, moves along and fully compresses the tubing through a first section of the periphery of the first disk 1506, and by simultaneously causing the one second roller, e.g., the second roller 1514, to move along and fully compresses the tubing in a first section of the periphery of the second disk 1512, and moving, after increasing the pressure of the portion of the fluid, the portion of the fluid through the tubing at a constant pressure towards an output of the tubing by causing the first rollers 1508, 1510 to orbit at the second angular speed while the one first roller, e.g., the first roller 1508, moves along and is fully compressing the tubing in a second section of the first disk 1506, and by simultaneously causing the one second roller, e.g., the second roller 1514, to fully compress the tubing.

In some embodiments, the controller 15140 may also include control logic for identifying intervals with a heightened probability of having air bubbles in the tubing, and increasing the pressure of the portion of the fluid in the tubing between one first roller and one second roller to account for air bubbles in the tubing between the one first roller and the one second roller. The system 1500 may also include a sensor 15142 that is configured to identify, determine the existence of, and/or measure air in the tubing. For instance, sensor 15142 is located such that it may detect air bubbles in uptake tubing 1518. The controller may then be able to measure and determine the amount of air that has entered tubing 1518. As stated previously, the controller may contain control logic for controlling, at least in part, the first rollers 1508, 1510 in order to increase the pressure to account for the air that has entered the tubing 1518.

The controller may also include control logic for determining the location of each of the first rollers on the first disk and the location of each of the second rollers on the second disk, which may be an angular sensor 15144 in the first motor 15134 and an angular sensor 15146 in second motor 15136. Such angular sensors 15144, 15146 may also be located in the system 1500 in locations such that they may detect the location(s) of each of the first and second rollers.

The controller may include control logic for determining the pressure in the tubing. Such logic may be calculating the pressure based, at least in part, on speed and/or distance along the periphery of the first disk the first rollers traveled. The system 1500 may also include one or more sensors that are configured to detect pressure in the tubing. Such a pressure sensor may be placed on or within the tubing, such as interconnecting tubing 1527, for example, as seen as pressure sensor 15148 in FIG. 15.

The controller may also be configured to receive an input from a user as to a desired output pressure of fluid flowing out of the outlet 1538 and to cause the first and second stages to move (as described herein) such that the flow pressure of fluid flowing out of the outlet 1538 substantially matches the desired output pressure that was input by the user (which may flow into a flow cytometer, nozzle, or flow cell, for instance). Accordingly, the system 1500 may include a user interface associated with controller 15140. The user interface may include a display screen, graphical software displays of the apparatus and/or process conditions, and user input devices such as pointing devices, keyboards, touch screens, microphones, etc. The controller 15140 may also be communicatively connected to the first motor 15134, the second motor 15136, and/or the sensor 15142, as illustrated by the use of dotted lines between these items.

While the examples provided herein have focused on peristaltic pumps with substantially round disks used in each stage, it is to be understood that the concepts discussed herein may also be applied to peristaltic pumps having non-round disks, e.g., oval or varying diameter disks. In such alternative embodiments, the drive motors governing the angular speeds at which the various rollers orbit their respective disks may be controlled so as to replicate the tangential speeds of the rollers relative to the disk perimeters (and thus the speeds of the rollers relative to the tubing with the fluid) discussed herein. For example, the motor driving the angular speed of the support arm for the second rollers may be controlled so that the second rollers travel around the second disk at a substantially constant tangential speed, e.g., the angular speed may increase when the second rollers are traversing a reduced-diameter portion of the second disk, and may decrease when the second rollers are traversing an increased-diameter portion of the second disk. The drive motor that controls the speed of the first rollers may be similarly controlled such that the first rollers' tangential speed relative to the tangential speed of the second rollers is in accordance with the relative tangential speeds of such rollers in the examples discussed earlier herein. Due to the fact that the pumping characteristics of the dual-stage peristaltic pumps discussed herein are ultimately controlled by the speeds at which the rollers in each stage move relative to the fluid transport tubing, it may technically be possible to arbitrarily change the mechanical configuration of the disks and "correct" out the effects of such changes in the mechanical configuration by altering the movement profiles of the drive motors so that such embodiments produce the same relative movement profiles between the rollers and the tubing as discussed above with respect to the provided examples. Such embodiments are to be understood as still falling within the scope of this disclosure.

It is to be understood that use of the term "substantially" in this application and the claims, unless otherwise indicated, refers to relationship that is within ±5% of the value specified. The term "substantially" may also be used, for instance, because there may be slight variations in speed or pressure due to manufacturing tolerances or other negligible contributing factors. For example, "substantially the same angular speed" would be within ±5% of the specified angular speed. In a further example, a pressure that substantially matches another pressure would be within ±5% of that other pressure. A substantially circular shape would be a shape that has a boundary falling that falls within an annulus with an inner and outer diameter within ±5% of the diameter of a particular true circle.

The term "each," as used herein, may be used to refer to every member of a group of multiple objects, as well as to refer to a single-object group. For example, if "at least one object" or "one or more objects" are introduced, and then followed by a later statement such as "for each object," "for each object of the one or more objects," or "for each object of the at least one object," this is meant to indicate that the description that follows such a statement is applicable to each instance of such an object—regardless of whether there is only one such object or multiple such objects. This is in contrast to the standard dictionary definition for the term "each," which implies that there must be at least two objects, but is consistent with the use of the term "each" or the phrase "for each" in computer programming and in set theory.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of pumping a fluid through a tubing that is positioned partially around a periphery of a first disk of a peristaltic pump and partially around a periphery of a second disk of the peristaltic pump, the method comprising:

orbiting one or more first rollers around the periphery of the first disk such that the one or more first rollers are pressed into contact with the periphery of the first disk, the tubing, or the periphery of the first disk and the tubing, wherein the first disk is substantially circular and has a first radius and wherein each first roller travels at the same angular speed as any other first roller at any given point in time;

orbiting a plurality of second rollers at a second angular speed around the entire periphery of the second disk such that the second rollers are pressed into contact with the periphery of the second disk, the tubing, or the periphery of the second disk and the tubing, wherein the second disk is substantially circular and has a second radius that is substantially the same as the first radius;

increasing a pressure of a portion of the fluid in the tubing between one first roller of the one or more first rollers and one second roller of the plurality of second rollers by causing the one or more first rollers to orbit at a first angular speed so that the one first roller moves along and fully compresses the tubing in a first section of the periphery of the first disk, and by simultaneously causing the one second roller to move along and fully compress the tubing in a first section of the periphery of the second disk, wherein the first angular speed is greater than the second angular speed; and moving, after increasing the pressure of the portion of the fluid, the portion of the fluid through the tubing at a constant pressure towards an output of the tubing by causing the one or more first rollers to orbit at the second angular speed while the one first roller moves along and is fully compressing the tubing in a second section of the periphery of the first disk, and by simultaneously causing the one second roller to fully compress the tubing.

2. The method of claim 1, further comprising reducing, after increasing the pressure of the portion of the fluid and before moving the portion of the fluid through the tubing at the constant pressure towards the output of the tubing, the angular speed of the one or more first rollers from the first angular speed to the second angular speed.

3. The method of claim 1, further comprising reducing, after moving the portion of the fluid through a part of the tubing at the constant pressure towards the output of the tubing, the angular speed of the one or more first rollers to a third angular speed that is less than the second angular speed.

4. The method of claim 3, wherein the third angular speed is zero.

5. The method of claim 3, wherein the one or more first rollers move at the third angular speed while each of the first rollers is not fully compressing the tubing.

6. The method of claim 3, wherein the one or more first rollers further comprise two or more first rollers, the method further comprising:

increasing, after reducing the angular speed of the two or more first rollers to the third angular speed, the pressure of another portion of the fluid in the tubing between another first roller of the two or more first rollers and another second roller of the plurality of second rollers by causing the two or more first rollers to orbit at the first angular speed while the another first roller moves along and fully compresses the tubing in the first section of the periphery of the first disk, and by simultaneously causing the another second roller to move along and fully compress the tubing in the first section of the periphery of the second disk, wherein the first angular speed is greater than the second angular speed.

7. The method of claim 6, wherein:

the third angular speed is zero, and the method further comprising orbiting, after stopping the movement of the two or more first rollers and before increasing the pressure of the another portion of the fluid in the tubing between the another first roller and the other second roller, the two or more first rollers at an angular speed less than or equal to the second angular speed.

8. The method of claim 3, wherein:

the one or more first rollers comprise two or more first rollers, the third angular speed is zero, and the method further comprising:

increasing, after stopping the movement of the two or more first rollers, the pressure of another portion of the fluid in the tubing between another first roller of the two or more first rollers and another second roller of the plurality of second rollers by causing the two or more first rollers to orbit at the first angular speed while the another first roller moves along and fully compresses the tubing in a third section of the periphery of the first disk, and by simultaneously causing the another second roller to move along and fully compress the tubing in a third section of the periphery of the second disk, wherein the first angular speed is greater than the second angular speed.

9. The method of claim 3, wherein:

the one or more first rollers comprise two or more first rollers, the third angular speed is zero, and the method further comprising:

increasing, after stopping the movement of the two or more first rollers, the pressure of another portion of the fluid in the tubing between another first roller of the two or more first rollers and another second roller of the plurality of second rollers by causing the two or more first rollers to orbit at a fourth angular speed while the another first roller moves along and fully compresses the tubing in the first section of the periphery of the first disk, and by simultaneously causing the another second roller to move along and fully compress the tubing in the first section of the periphery of the second disk, wherein the fourth angular speed is greater than the second angular speed.

10. The method of claim 3, wherein:

the one or more first rollers comprise two or more first rollers, the third angular speed is zero, and the method further comprising:

increasing, after stopping the movement of the two or more first rollers, the pressure of another portion of the fluid in the tubing between another first roller of the two or more first rollers and another second roller of the plurality of second rollers by causing the two or more first rollers to orbit at a fifth angular speed while the another first roller moves along and fully compresses the tubing in a fourth section of the periphery of the first disk, and by simultaneously causing the another second roller to move along and fully compress the tubing in a fourth section of the periphery of the second disk, wherein the fifth angular speed is different than the first angular speed and is greater than the second angular speed.

11. The method of claim 1, wherein increasing the pressure of the portion of the fluid in the tubing between the one first roller and the one second roller accounts for air bubbles in the tubing between the one first roller and the one second roller by causing the one first roller to move to decrease the volume of the tubing between the one first roller and the one second roller.

12. The method of claim 11, further comprising identifying intervals with a heightened probability of having the air bubbles in the tubing, wherein the identifying is based, at least in part, on data selected from the group consisting of: (a) data on the incremental movements of the one or more first rollers that move fluid from an uptake probe to the tubing while the uptake probe is in air and (b) data from a sensor configured to detect or measure air in the tubing.

13. The method of claim 1, wherein moving the portion of the fluid through the tubing at the constant pressure towards the output of the tubing further comprises:

causing, after the one first roller has moved along the second section of the periphery of the first disk:

the one first roller to move along a third section of the periphery of the first disk, the one first roller to fully compress the tubing at at least a beginning of the third section of the periphery of the first disk in a direction of rotation of the first roller with respect to the first disk, and the one first roller to not fully compress the tubing at at least an end of the third section of the periphery of the first disk in the direction of rotation of the first roller with respect to the first disk; and causing another second roller of the plurality of second rollers to fully compress the tubing against the second disk before causing the one first roller to not fully compress the tubing at at least the end of the third section of the periphery of the first disk.

14. A system, comprising:

a first disk that is substantially circular, has a nominal radius, and includes a first recess in a periphery of the first disk, the first recess configured to receive a first portion of a tubing for conveying fluid;

a second disk that is substantially circular, has substantially the nominal radius, and includes a second recess in a periphery of the second disk, the second recess configured to receive a second portion of the tubing;

one or more first rollers that are configured to orbit around the periphery of the first disk such that each first roller travels at the same angular speed as any other first roller at any given point in time, and that are configured to press into contact with the periphery of the first disk, the first portion of the tubing, or the periphery of the first disk and the first portion of the tubing;

a first motor configured to cause the one or more first rollers to orbit the periphery of the first disk at two or more angular speeds;

a plurality of second rollers that are configured to orbit around the periphery of the second disk and configured to press into contact with the periphery of the second disk, the second portion of the tubing, or the periphery of the second disk and the second portion of the tubing;

a second motor configured to cause the plurality of second rollers to orbit the periphery of the second disk at a constant angular speed; and a controller for controlling the system, the controller comprising control logic for:

controlling the first motor to cause the one or more first rollers to orbit around the periphery of the first disk at a first angular speed and a second angular speed that is less than the first angular speed, controlling the second motor to cause the plurality of second rollers to orbit around the entire periphery of the second disk at the second angular speed, increasing a pressure of a portion of the fluid in the tubing between one first roller of the one or more first rollers and one second roller of the plurality of second rollers by controlling the first motor to cause the one or more first rollers to orbit the first disk at the first angular speed so that the one first roller moves along and fully compresses the tubing through a first section of the periphery of the first disk, and by simultaneously controlling the second motor to cause the one second roller to orbit the second disk at the second angular speed and move along and fully compress the tubing in a first section of the periphery of the second disk, and moving, after increasing the pressure of the portion of the fluid, the portion of the fluid through the tubing at a constant pressure towards an output of the tubing by controlling the first motor to cause the one or more first rollers to orbit the first disk at the second angular speed while the one first roller moves along and is fully compressing the tubing in a second section of the first disk, and while the one second roller is fully compressing the tubing.

15. The system of claim 14, wherein the controller further comprises control logic for:

identifying intervals with a heightened probability of having air bubbles in the tubing wherein the identifying is based, at least in part, on data selected from the group consisting of: (a) data on the incremental movements of the one or more first rollers that move fluid from an uptake probe to the tubing while the uptake probe is in air and (b) data from a sensor configured to detect or measure air in the tubing, and increasing, by controlling the first motor to cause the first angular speed to increase, the pressure of the portion of the fluid in the tubing between the one first roller and the one second roller to account for air bubbles in the tubing between the one first roller and the one second roller.

16. The system of claim 15, further comprising the sensor configured to detect or measure air in the tubing.

17. The system of claim 14, wherein the controller further comprises control logic for determining a location of each of the first rollers relative to the first disk and a location of each of the second rollers relative to the second disk.

18. The system of claim 14, wherein the controller further comprises control logic for determining the pressure in the tubing from a pressure sensor that is in fluidic communication with the tubing.

19. The system of claim 14, wherein the controller further comprises control logic for controlling the first motor to stop the movement of the one or more first rollers at least once for each complete orbit of the plurality of second rollers around the second disk.

* * * * *